US008418807B1

(12) United States Patent
Nevins et al.

(10) Patent No.: US 8,418,807 B1
(45) Date of Patent: Apr. 16, 2013

(54) NOISE ABATEMENT WALL AND A NOISE ABATEMENT WALL SYSTEM

(75) Inventors: Scott A. Nevins, Gettysburg, PA (US); William E. Nuckolls, Walkersville, MD (US)

(73) Assignee: Evapco, Inc., Westminster, MD (US)

( * ) Notice: Subject to any disclaimer, the term of this patent is extended or adjusted under 35 U.S.C. 154(b) by 0 days.

(21) Appl. No.: 13/351,921

(22) Filed: Jan. 17, 2012

(51) Int. Cl.
*E04B 1/82* (2006.01)

(52) U.S. Cl.
USPC ..... 181/293; 181/210; 181/284; 52/144; 52/145

(58) Field of Classification Search ..... 181/293, 181/290, 284, 210; 52/144, 145
See application file for complete search history.

(56) References Cited

U.S. PATENT DOCUMENTS 3,611,907 A * 10/1971 Wasserman et al. ..... 454/186
3,951,228 A * 4/1976 Schnell ..... 181/200
5,123,874 A * 6/1992 White, III ..... 454/251
5,210,984 A * 5/1993 Eckel ..... 52/79.5
5,663,536 A 9/1997 Kaplan
5,907,932 A * 6/1999 LeConte et al. ..... 52/144
7,111,831 B2 9/2006 Hentschel et al.
7,467,687 B2 * 12/2008 Mitchell et al. ..... 181/200
7,604,095 B2 * 10/2009 Mitchell ..... 181/290
7,823,693 B2 * 11/2010 Boyce ..... 181/284

* cited by examiner

*Primary Examiner* — Forrest M Phillips
(74) *Attorney, Agent, or Firm* — Rader, Fishman & Grauer PLLC

(57) ABSTRACT

A noise abatement wall includes a frame defining a window, at least one shell, at least one sheet of sound-insulating material and a sheet of screen material. The at least one shell has a base panel portion and a peripheral panel portion integrally formed with and extending perpendicularly from the base panel portion to surround the base panel portion thereby forming a shell cavity. The at least one shell is sized and configured to be received by the window in a close-fitting relationship therewith and is connected to the frame. The at least one sheet of sound-insulating material is disposed in and occupies the shell cavity. The sheet of screen material covers the at least one sheet of sound-insulating material and is connected to the frame. A plurality of noise abatement walls are connected together to form a noise abatement wall system for abating noise generated from stationary noise-generating equipment.

27 Claims, 27 Drawing Sheets

NOISE ABATEMENT WALL AND A NOISE ABATEMENT WALL SYSTEM

FIELD OF THE INVENTION

The present invention relates to a noise abatement wall and a noise abatement wall system constructed from a plurality of noise abatement walls.

BACKGROUND OF THE INVENTION

Noise is unwanted sound. Sound is transmitted by pressure variations in air from its source to the surroundings. Many sounds or noises encountered in daily life are from roadways, aircraft and mechanical equipment. One way to mitigate noise from roadways is by constructing a noise abatement wall system between roadways and living areas. One way to mitigate noise from mechanical equipment is by constructing the noise abatement wall system to surround the mechanical equipment.

It is well known in the industry to construct a noise abatement wall system that surrounds the mechanical equipment, for instance, an evaporative cooling unit, to mitigate noise generated by it. Sometimes such a noise abatement wall system is a stand-alone structure that is set apart from the evaporative cooling unit at a selected distance and is constructed at the location of the evaporative cooling unit. Such a noise abatement wall system might require a separate foundation on which the noise abatement wall rests or might require partially-buried support posts onto which individual noise abatement walls are secured. As a result, much effort is required at the construction or set-up site of the evaporative cooling unit to construct the noise abatement wall system.

It would be beneficial to provide a noise abatement wall and a noise abatement wall system in which noise abatement walls were constructed at the factory and thereafter delivered to the construction or set-up site of the evaporative cooling unit to assemble the noise abatement wall system. It would be advantageous if the noise abatement walls could be secured to the evaporative cooling unit itself after its construction or set-up in the field. The present invention provides this benefit and this advantage.

OBJECTS AND SUMMARY OF THE INVENTION

It is an object of the invention to provide a noise abatement wall and a noise abatement wall system in which noise abatement walls are constructed at the factory and delivered to the construction or set-up site for assembly of the noise abatement wall system surrounding noise-generating mechanical equipment.

It is another object of the invention to provide the noise abatement walls that could be secured to the noise-generating mechanical equipment itself after its construction or set-up in the field.

Accordingly, a noise abatement wall of the present invention and a noise abatement wall system of the present invention are hereinafter described.

One embodiment of the present invention is a noise abatement wall that includes a frame defining a window, at least one shell, at least one sheet of sound-insulating material and a sheet of screen material. The at least one shell has a base panel portion and a peripheral panel portion integrally formed with and extending perpendicularly from the base panel portion to surround the base panel portion thereby forming a shell cavity. Also, the at least one shell is sized and configured to be received by the window in a close-fitting relationship therewith and is connected to the frame. The at least one sheet of sound-insulating material is disposed in and occupies at least substantially all of the shell cavity. The sheet of screen material covers the at least one sheet of sound-insulating material and connected to the frame.

Another embodiment of the present invention is a noise abatement wall that includes the frame that defines the window, a cover panel, the at least one sheet of sound-insulating material and the sheet of screen material. The frame has a front frame face and a rear frame face. The cover panel is sized to cover the window and is connected to the front frame face of the frame. The at least one sheet of sound-insulating material disposed in the window and contacts the cover panel. The sheet of screen material covers the at least one sheet of sound-insulating material and is connected to the rear frame face of the frame.

Yet another embodiment of the present invention is a noise abatement wall system that is adapted to abate noise generated from stationary noise-generating equipment. The noise abatement wall system includes a plurality of noise abatement walls described hereinabove. The plurality of noise abatement walls are connected together in a juxtaposed configuration to surround the stationary noise-generating equipment.

The present invention will be better appreciated in view of the detailed description of the exemplary embodiments of the present invention with reference to the accompanying drawings, in which:

DETAILED DESCRIPTION OF THE EXEMPLARY EMBODIMENTS

Figure 1:
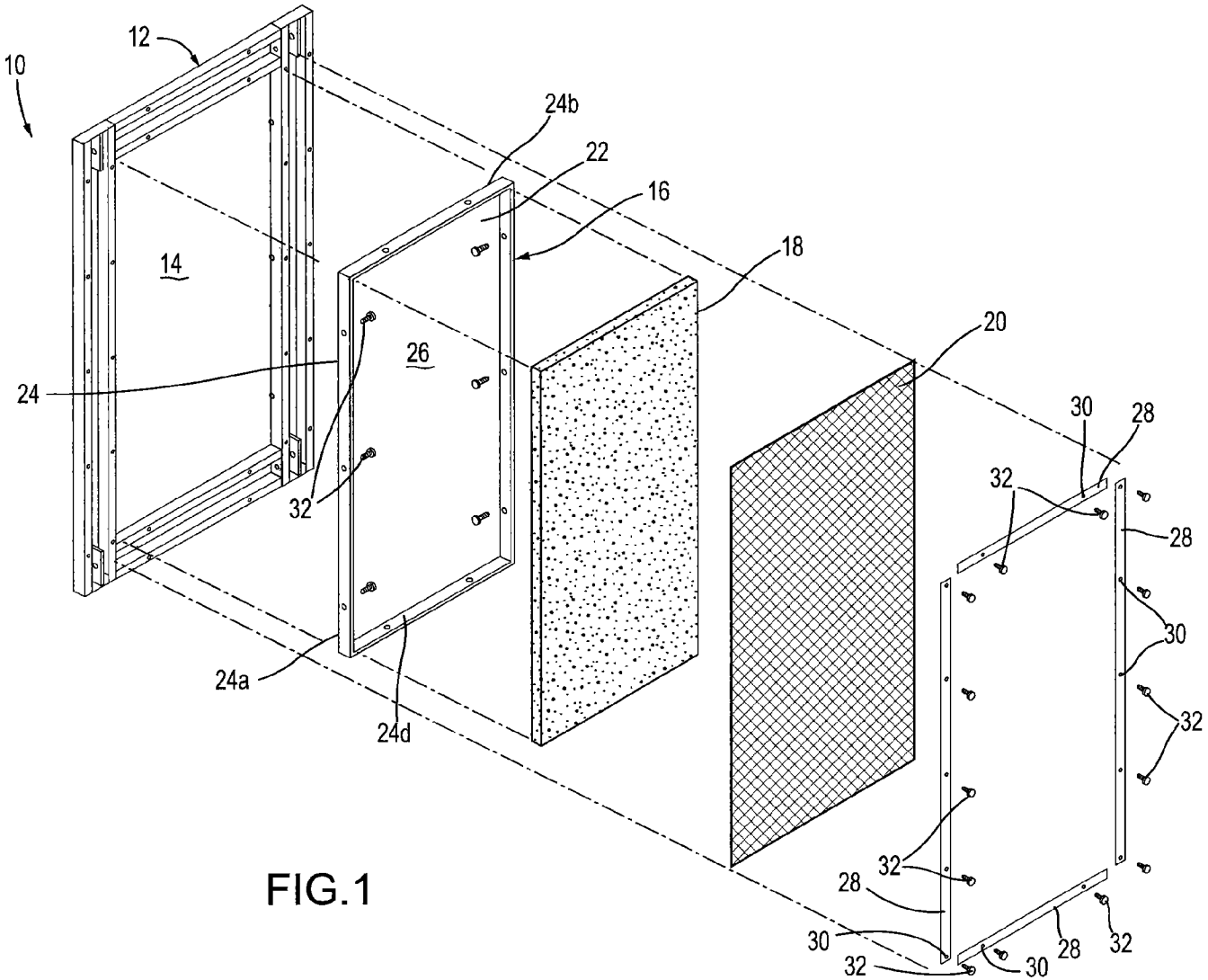
FIG. 1 is a rear, exploded perspective view of a first exemplary embodiment of a noise abatement wall of the present invention.

Hereinafter, embodiments of the present invention will be described with reference to the attached drawings. The structural components common to the structural components common to respective embodiments of the present invention will be represented by the same symbols and repeated description thereof will be omitted.

A first exemplary embodiment of a noise abatement wall 10 of the present invention is illustrated in FIGS. 1-9. The noise abatement wall 10 includes a frame 12 that defines a window 14, a shell 16, a sheet of sound-insulating material 18 and a sheet of screen material 20. The shell 16 has a base panel portion 22 and a peripheral panel portion 24. The peripheral panel portion 24 is integrally formed with the base panel portion 22 and extends perpendicularly from the base panel portion 22 to surround the base panel portion 22 thereby forming a shell cavity 26. The shell 16 is sized and is configured to be received by the window 14 in a close-fitting relationship (FIGS. 2 and 9) and, thereafter, is connected to the frame 12 as discussed in more detail below. The frame 12 and the shell 16 can be fabricated from any rigid material such as metal, wood or resin. The sheet of sound-insulating material 18 can be any conventional sound-insulating material such as foam, vinyl or batting material and is disposed in the shell cavity 26. The sheet of screen material 20 covers the sheet of sound-insulating material 18 and is connected to the frame 12 as discussed in more detail below. The sheet of screen material 20 can be any conventional screen material. However, it is preferable that the sheet of screen material 20 is a stiff yet pliable screen material.

Figure 4:
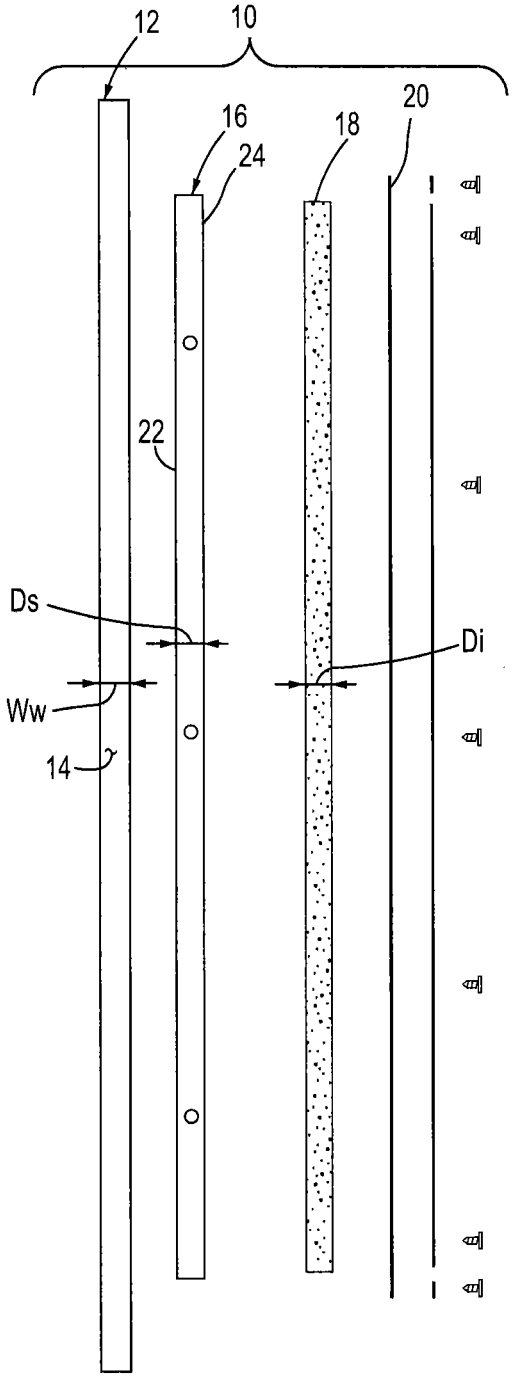
FIG. 4 is an exploded side elevation view the first exemplary embodiment of the noise abatement wall of the present invention.
Figure 5:
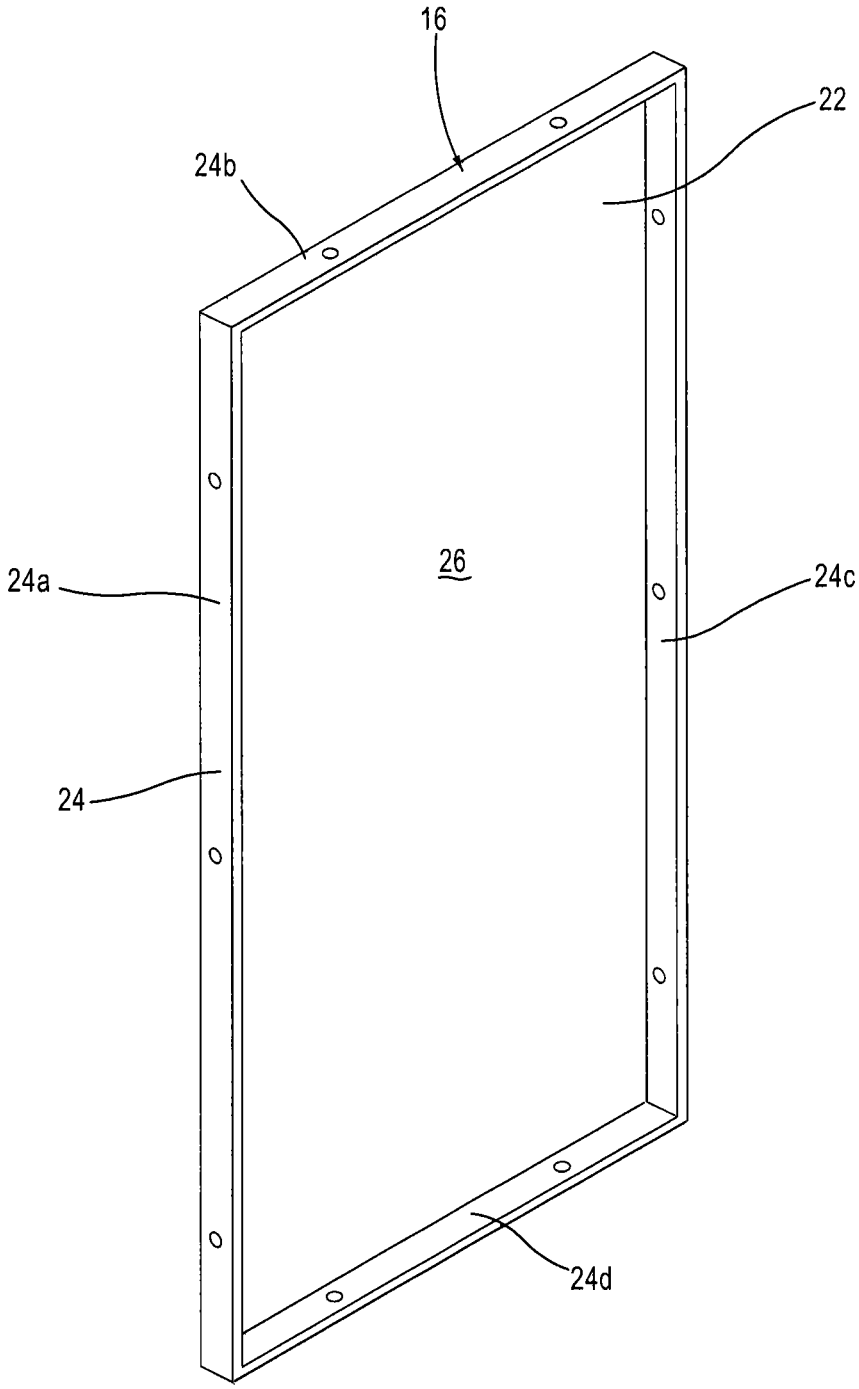
FIG. 5 is a perspective view of a shell that is a component of the first exemplary embodiment of the noise abatement wall of the present invention.

As shown in FIGS. 1, 4 and 5, the base panel portion 22 of the shell 16 is flat and rectangularly shaped. As best shown in FIG. 5, the peripheral panel portion 24 of the shell 16 includes four flat and rectangularly-shaped peripheral panel portion sections 24*a*-24*c*. Note that consecutive ones of the peripheral panel portion sections, namely, 24*a* to 24*b*, 24*b* to 24*c*, 24*c* to 24*d* and 24*d* to 24*a*, are perpendicularly and integrally connected together. The consecutive ones of the peripheral panel portion sections 24*a*-24*d* and the base panel portion 16 form the shell cavity 26 in a box shape. Thus, with the sound-insulating material 18 being configured in a box shape, the sheet of sound-insulating material 18 is sized to occupy the entirety of the shell cavity 26 or, at least, substantially the entire shell cavity 26.

Figure 2:
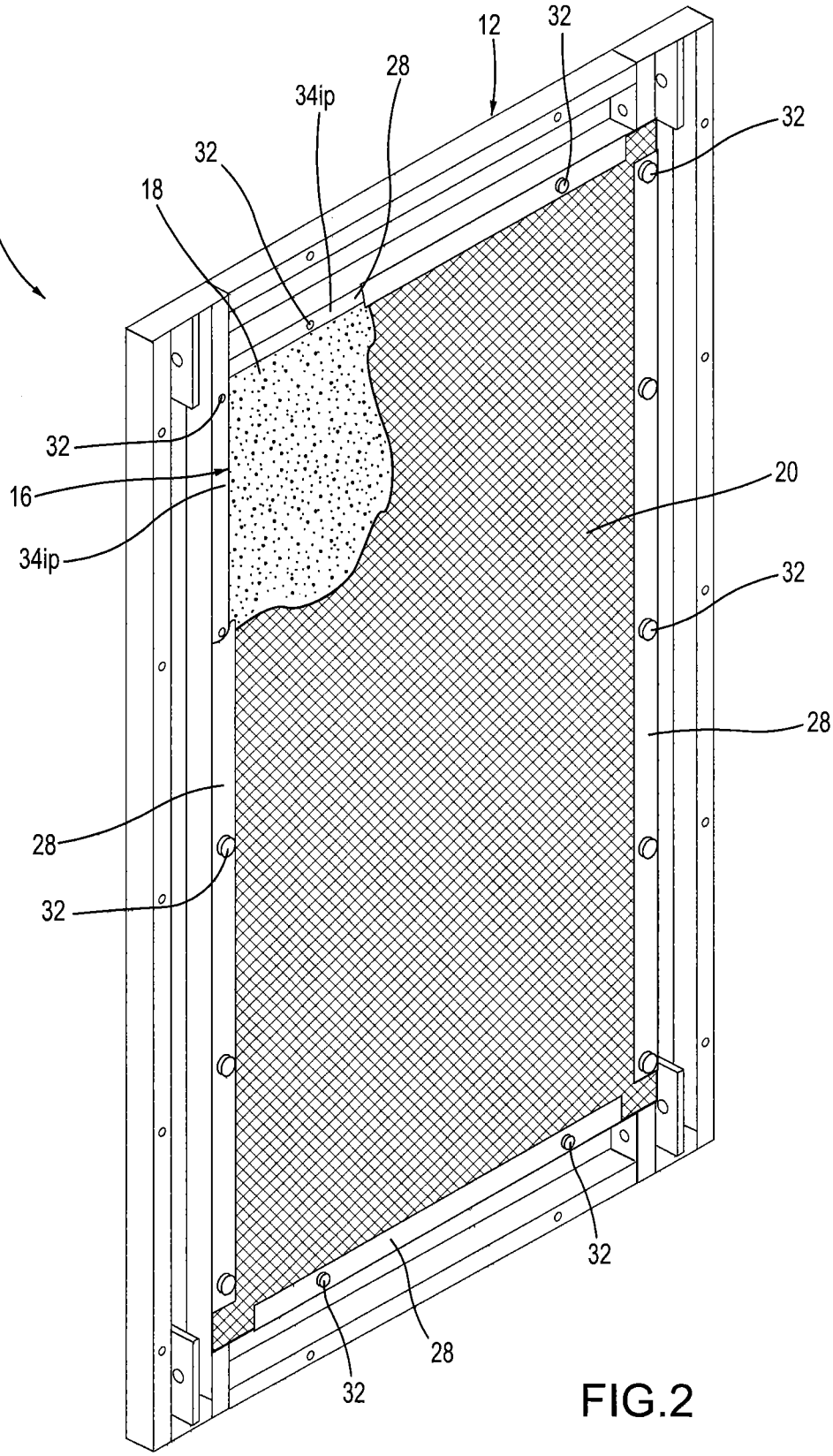
FIG. 2 is a rear perspective view of the first exemplary embodiment of the noise abatement wall of the present invention in its assembled state.
Figure 3:
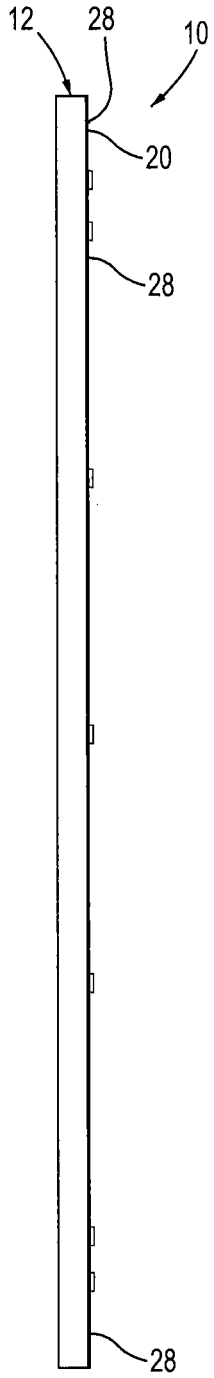
FIG. 3 is a side elevation view of the first exemplary embodiment of the noise abatement wall of the present invention.

In FIGS. 1-4, the noise abatement wall 10 also includes a plurality of strip members 28. Each one of the plurality of strip members 28 has a plurality of holes 30 formed therethrough as best shown in FIGS. 1 and 2. With the sheet of screen material 20 disposed between respective ones of the strip members 28 and the frame 12, respective ones of the strip members 28 are connected to the frame 12 by a plurality of conventional fasteners 32 such as screws. The sheet of screen material 20 and the sheet of sound-insulating material 18 are in facial contact with each other as shown in FIGS. 1 and 4. Now, when the respective ones of the strip members 28 are connected to the frame 12 with the sheet of screen material 20 disposed between the respective ones of the strip members 28 and the frame 12, as illustrated in FIGS. 2 and 9, the sheet of screen material 20 retains the sheet of sound-insulating material 18 inside the shell cavity 26.

Figure 6:
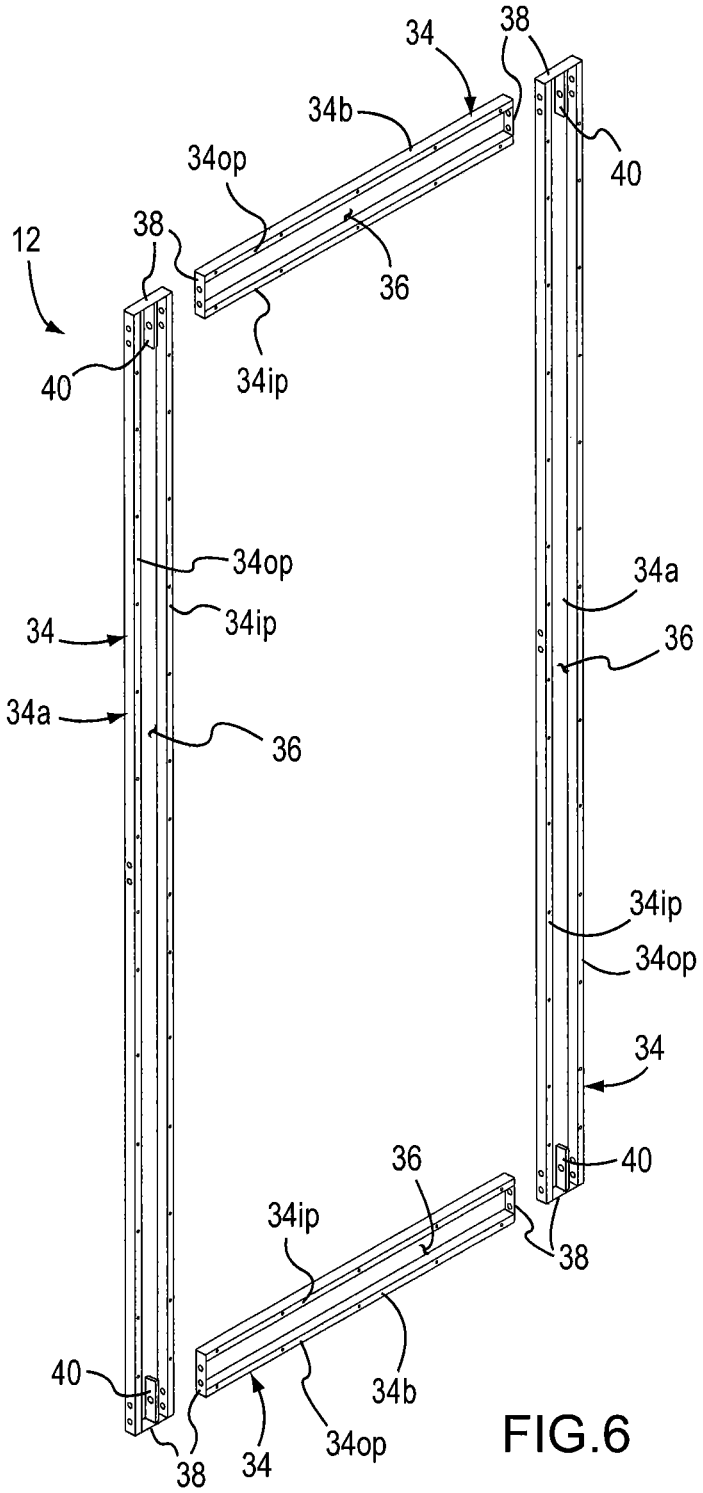
FIG. 6 is an exploded perspective view of a frame that is a component of the first exemplary embodiment of the noise abatement wall of the present invention.
Figure 7:
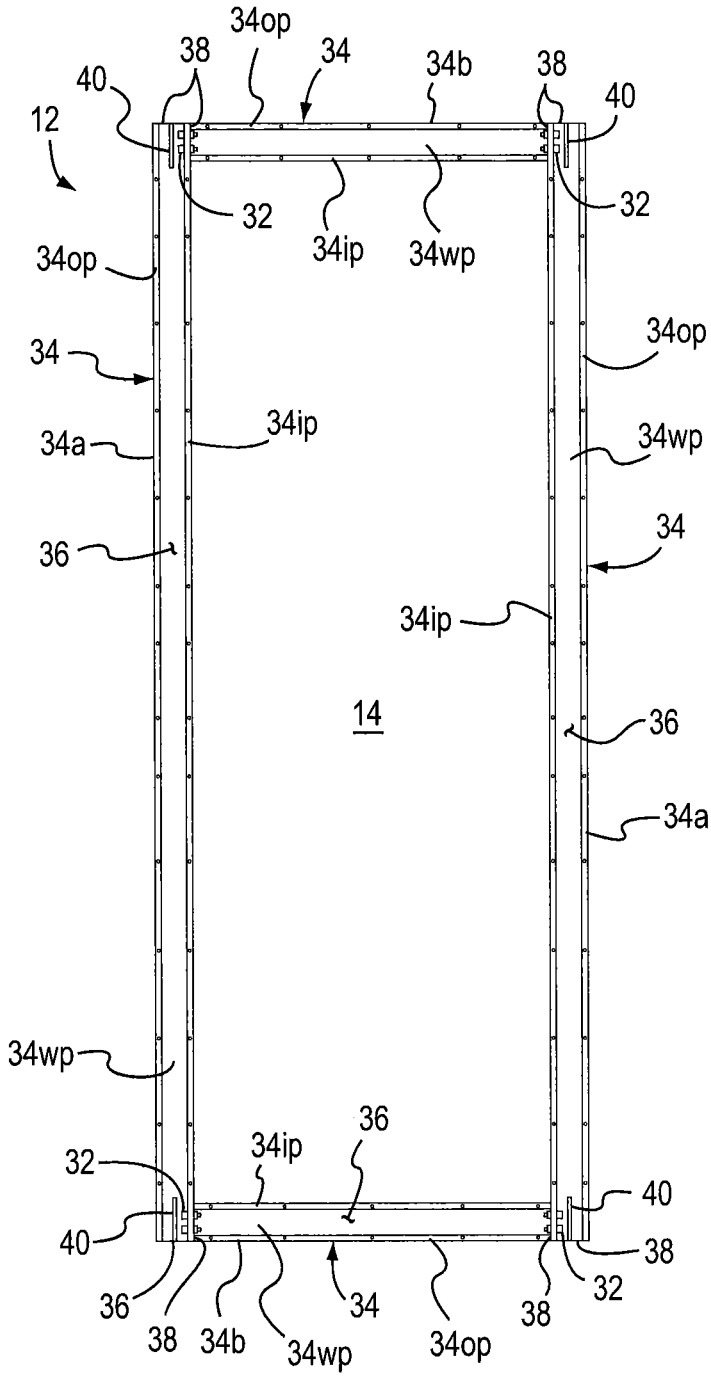
FIG. 7 is an assembled front elevation view of the frame shown in FIG. 6.
Figure 8:
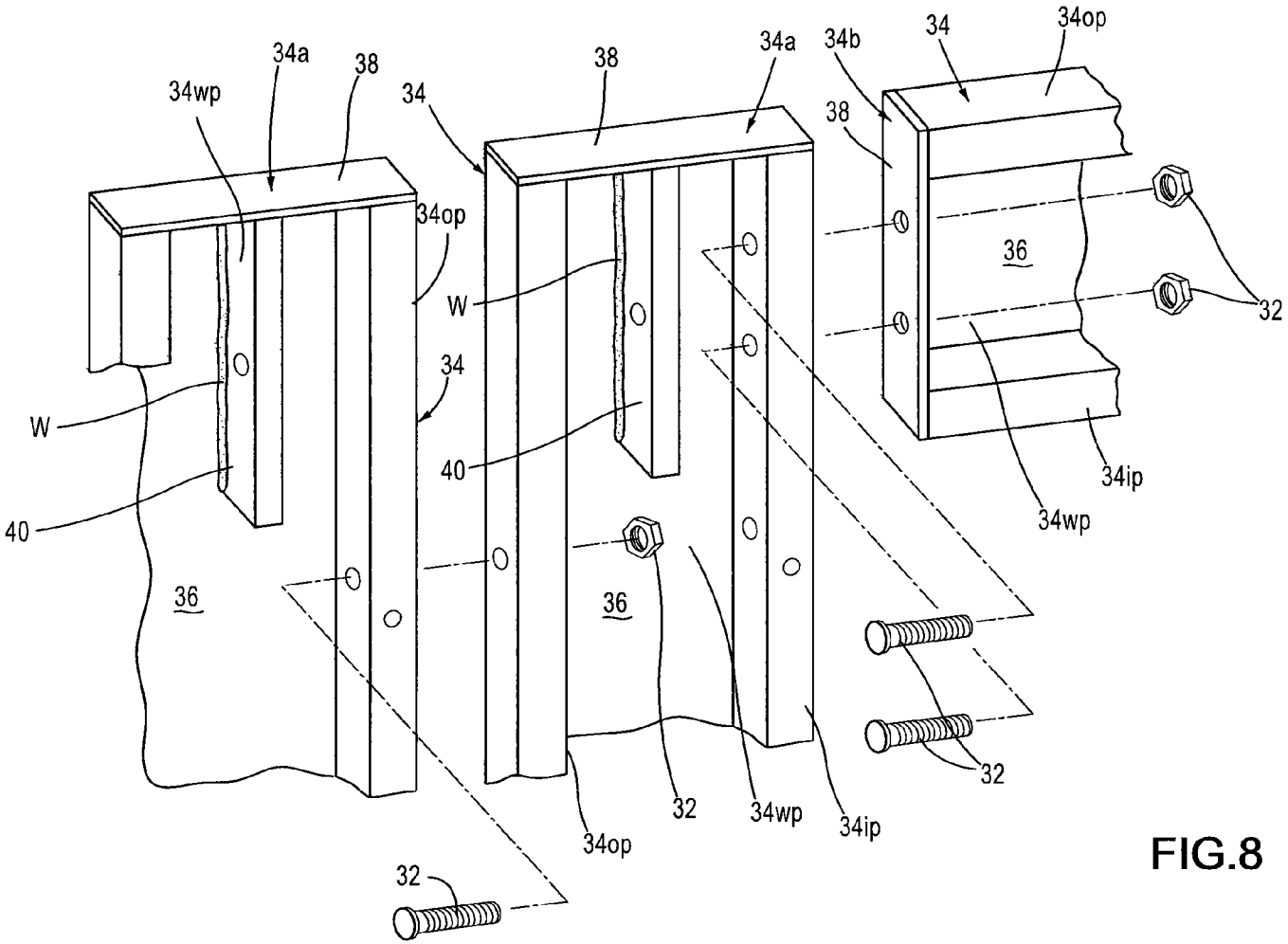
FIG. 8 is a partial, enlarged, exploded perspective view of one frame juxtaposed another.

With reference to FIG. 6, the frame 12 includes a plurality of frame pieces 34. There are two types of frame pieces 34, namely, a pair of side frame pieces 34*a* and a pair of outer cross frame pieces 34*b*. The pair of side frame pieces 34*a* are disposed apart from one another and extend parallel to one another. Also, the pair of outer cross frame pieces 34*b* are disposed apart from one another and extend parallel to one another. In FIGS. 7-9, respective ones of the pair of side frame pieces 34*a* and the pair of outer cross frame pieces 34*b* are perpendicularly connected together by conventional fasteners 32 such as nuts and bolts or screws to form the window 14 as a rectangular shape. A skilled artisan would appreciate that the conventional fasteners 32 extend through axially-aligned holes 33 formed in respective ones of the frame pieces 34.

Figure 9:
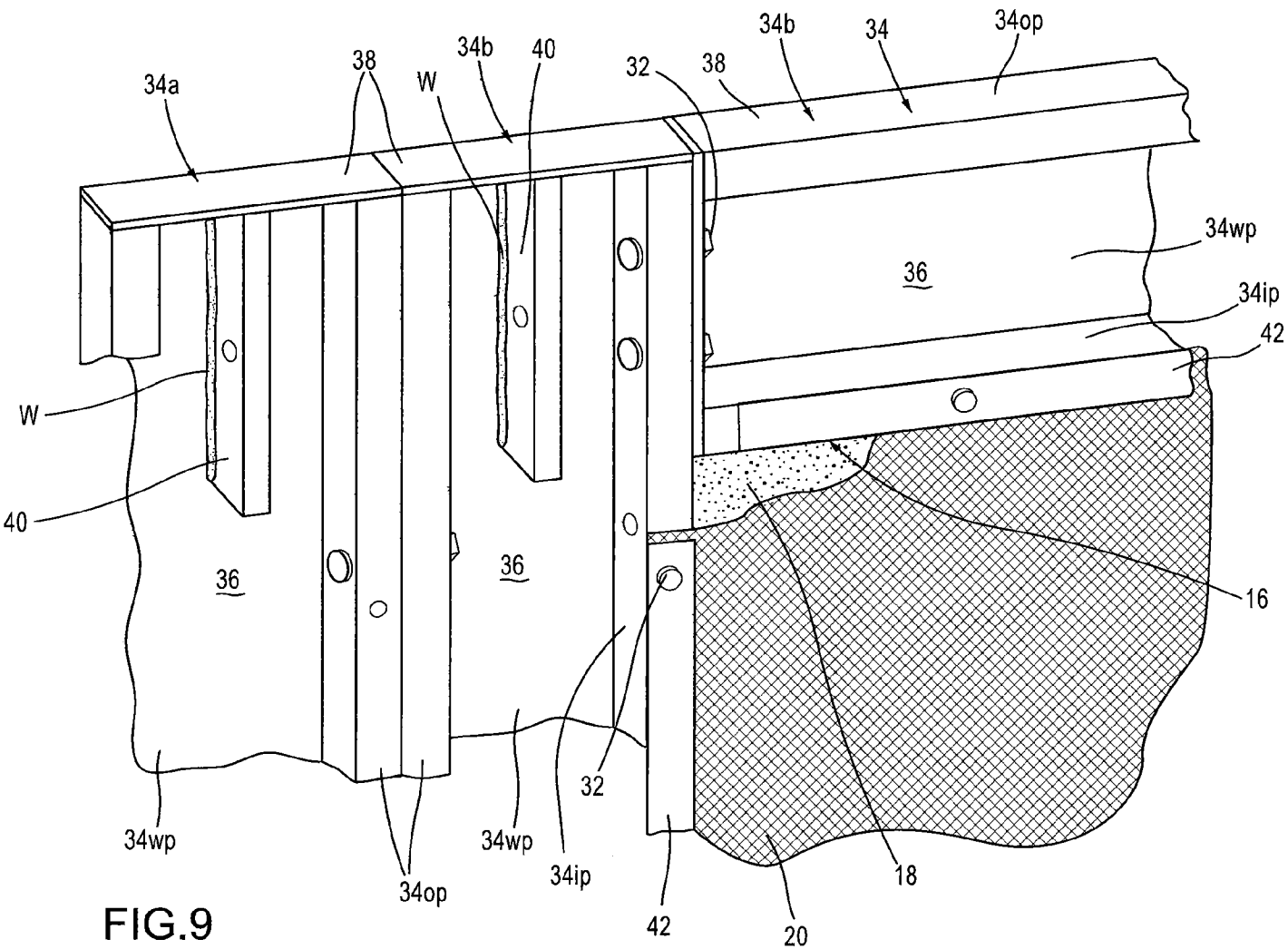
FIG. 9 is a partial, enlarged, assembled perspective view of the frames shown in FIG. 8.

In FIGS. 6-9, each one of the frame pieces 34 includes an outer rectangular-tubing portion 34*op*, an inner rectangular-tubing portion 34*ip* and a web portion 34*w*. The outer rectangular-tubing portion 34*op* and an inner rectangular-tubing portion 34*ip* are disposed apart from each other and extend parallel to one another. The terms "outer" and "inner" are used for reference only relative to the window 36. In other words, the inner rectangular-tubing tubing portion 34*ip* is not only more closely positioned to the web portion 34*wp* than the outer rectangular-tubing portion 34*op* but also the inner rectangular-tubing portion 34*ip* actually defines the window 36. The web portion 34*wp* extends between and interconnects the outer rectangular-tubing portion 34*op* and the inner rectangular-tubing portion 34*ip* to form a channel 36. The channel 36 extends along and between the outer rectangular-tubing portion 34*op* and the inner rectangular-tubing portion 34*ip*. Furthermore, each one of the frame pieces 34 has a pair of end parts 38 in a form of plates facially opposed to and disposed apart from each other. Each end part 38 extends across and between the respective ends of the outer and inner rectangular-tubing portions 34*op* and 34*ip* respectively and are connected to the web portion 34*wp* to close the channel 36 between and among the outer rectangular-tubing portion 34*op*, the inner rectangular-tubing portion 34*ip*, the web portion 34*wp* and the pair of end parts 38. Additionally, as shown in FIGS. 2 and 9, when the respective ones of the strip members 28 are connected to the frame 12 with the sheet of screen material 20 disposed between the respective ones of the strip members 28 and the frame 12, the respective ones of the strip members are connected to the inner rectangular-tubing portions 34*ip* by conventional fasteners 32 such as screws.

Again, with reference to FIGS. 6-9, the first exemplary embodiment of the noise abatement wall 10 of the present invention includes a plurality of support connectors 40 disposed in the closed channel 36 and is connected to the web portion 34*wp* and between the outer and inner rectangular-tubing portions 34*op* and 34*ip* respectively. For the first exemplary embodiment of the noise abatement wall 10 of the present invention, one support connector 40 is connected to the web portion 34*w* by weldment W, for example, at opposing ends of each one of the pair of side frame pieces 34*a*. As best illustrated in FIGS. 1 and 2, the shell 16 is connected at its peripheral panel portion sections 24*a*-24*d* to the inner rectangular-tubing portions 34*ip*.

As best shown in FIGS. 8 and 9 by way of example only, one side frame piece 34*a* and one outer cross frame piece 34*b* are connected together. In this manner, one end part 38 of the outer cross frame piece 34*b* abuts the inner rectangular-tubing portion 34*ip* of the side frame piece 34*a* and are releasably connected together with mechanical fasteners 32 (nuts and bolts).

Figure 10:
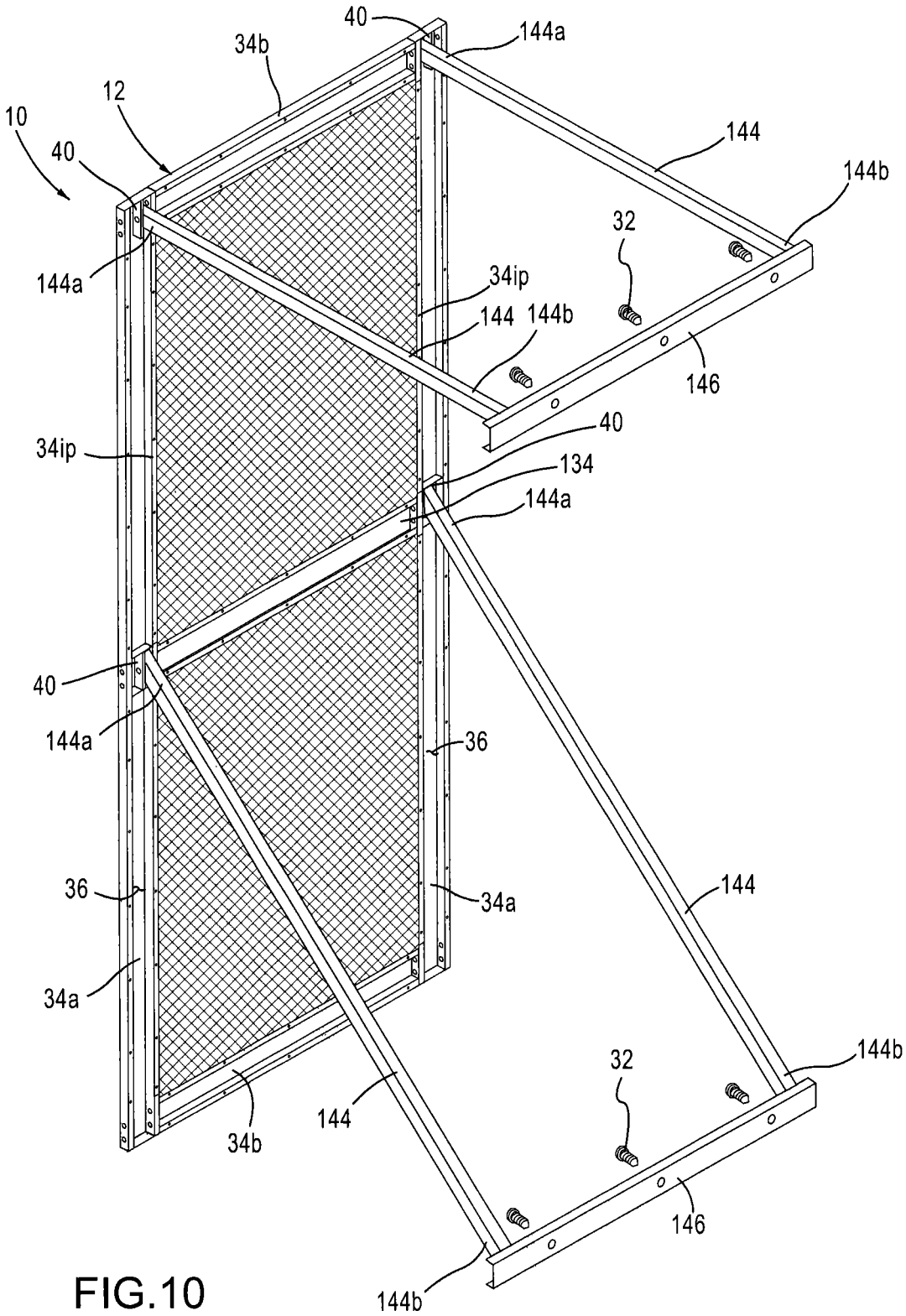
FIG. 10 is a rear, assembled perspective view of a second exemplary embodiment of the noise abatement wall of the present invention.
Figure 11:
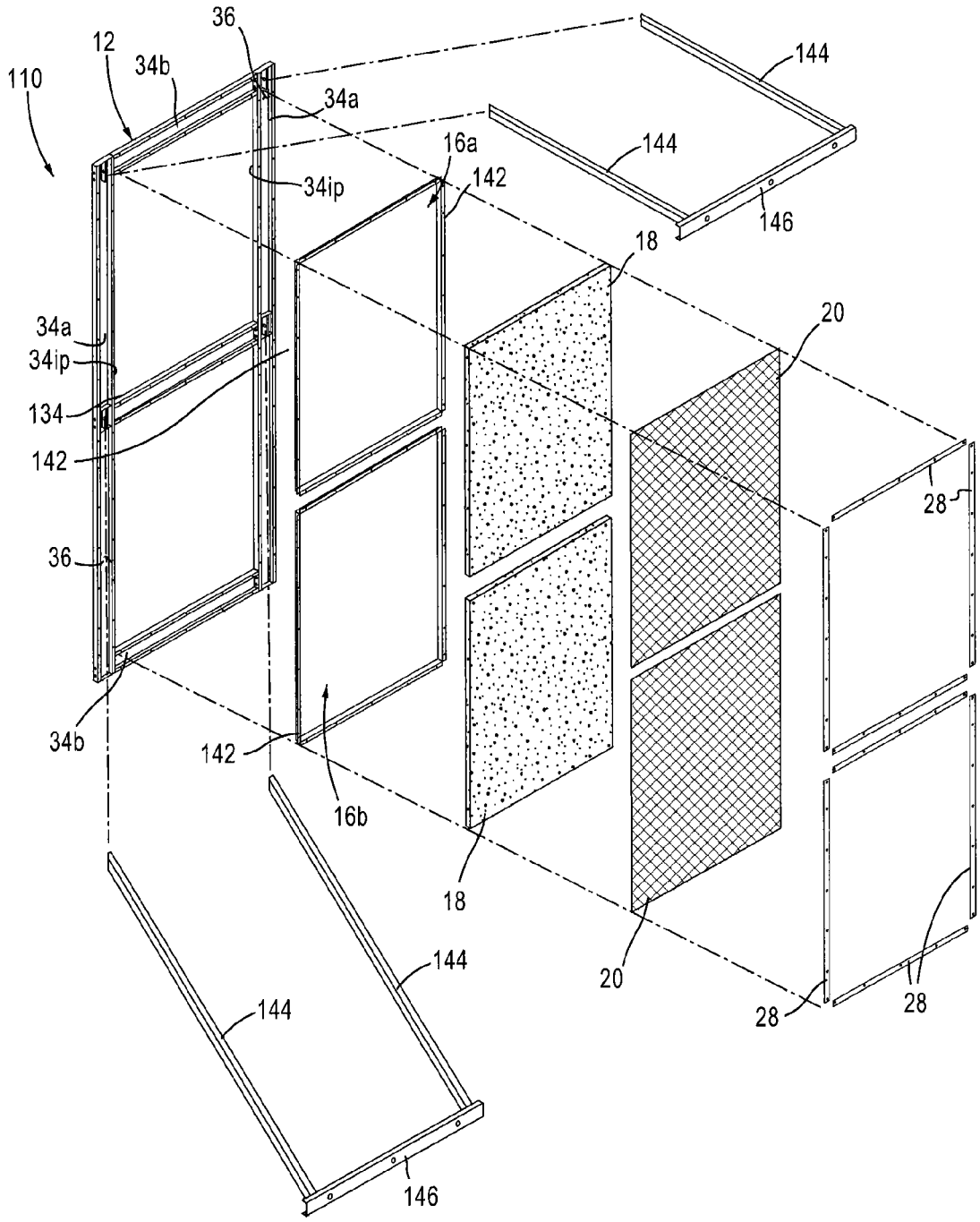
FIG. 11 is a rear, exploded perspective view of the second exemplary embodiment of the noise abatement wall of the present invention shown in FIG. 10.
Figure 12:
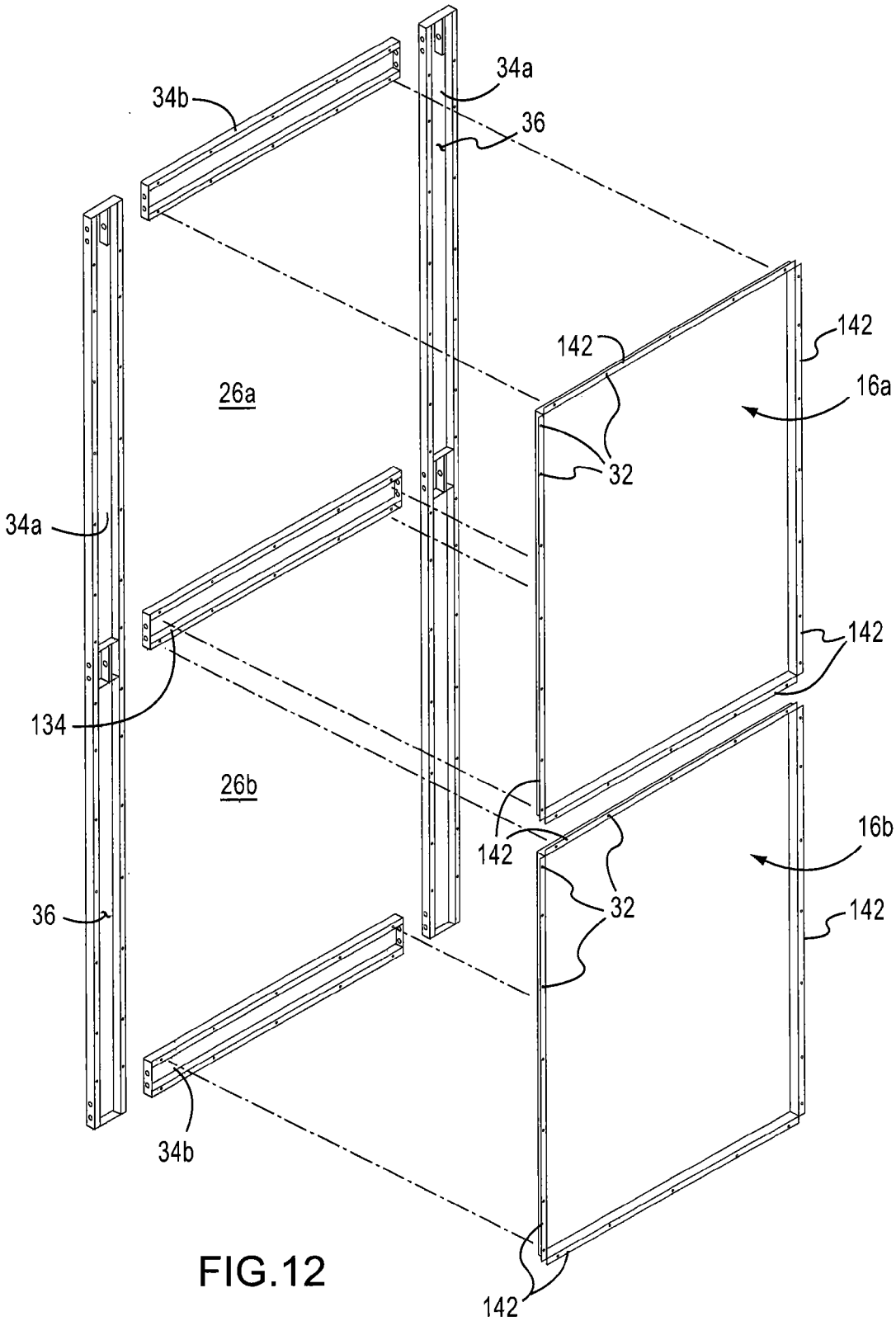
FIG. 12 is a rear, exploded perspective view of the frame and two shells of the second exemplary embodiment of the noise abatement wall of the present invention.
Figure 13:
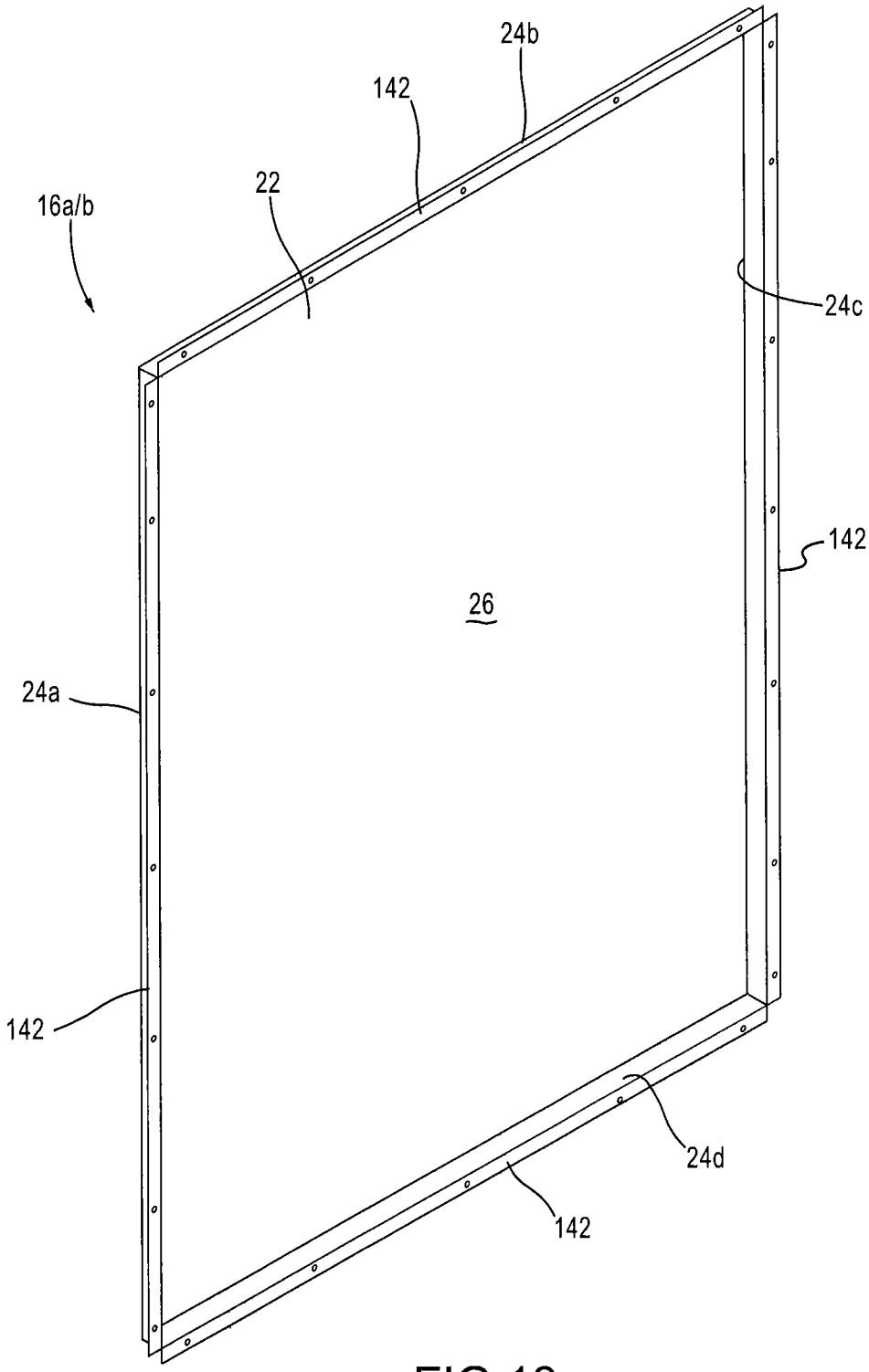
FIG. 13 is an enlarged perspective view of one shell shown in FIG. 12.
Figure 14:
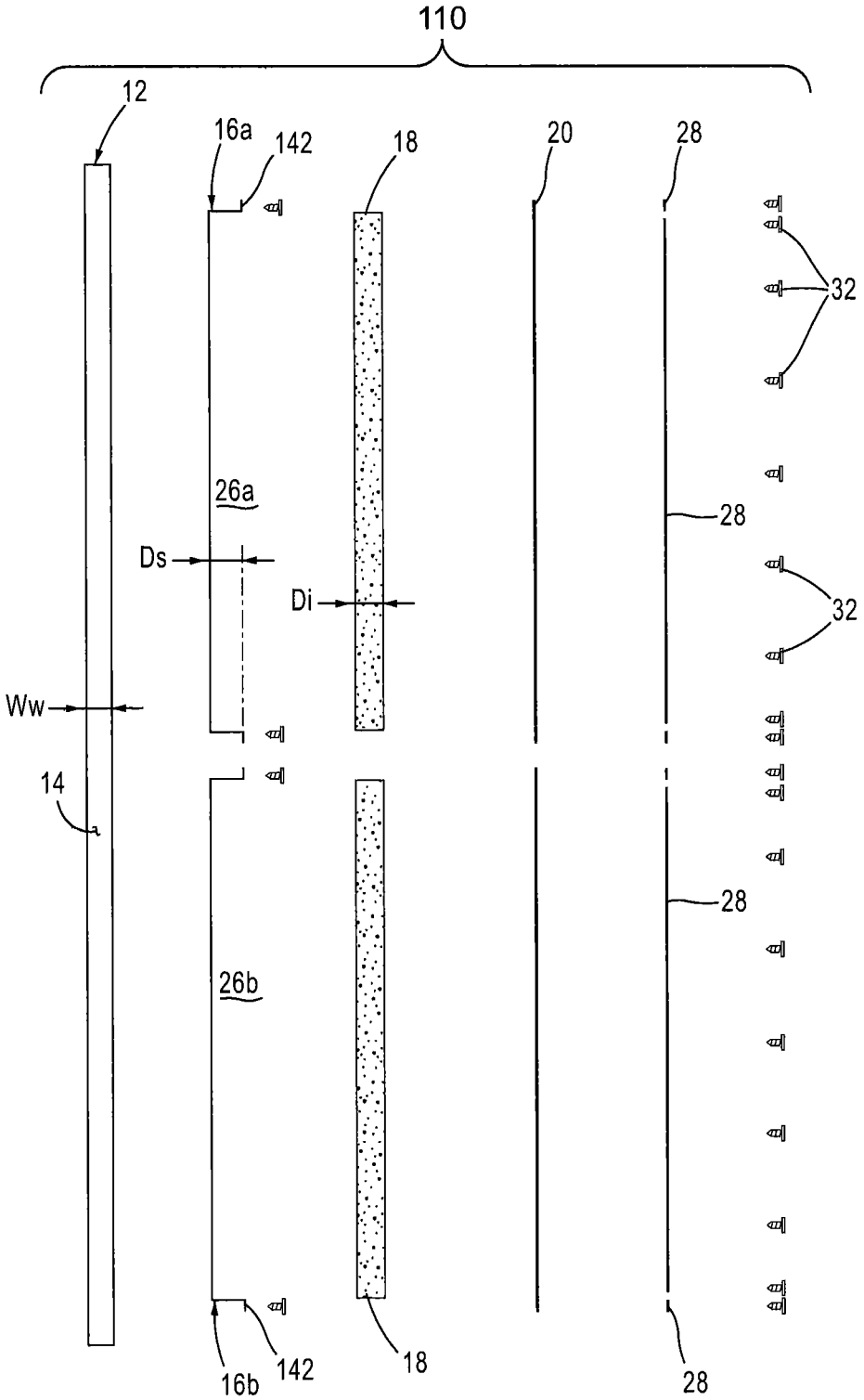
FIG. 14 is an exploded side elevation view of the second exemplary embodiment of the noise abatement wall of the present invention.
Figure 15:
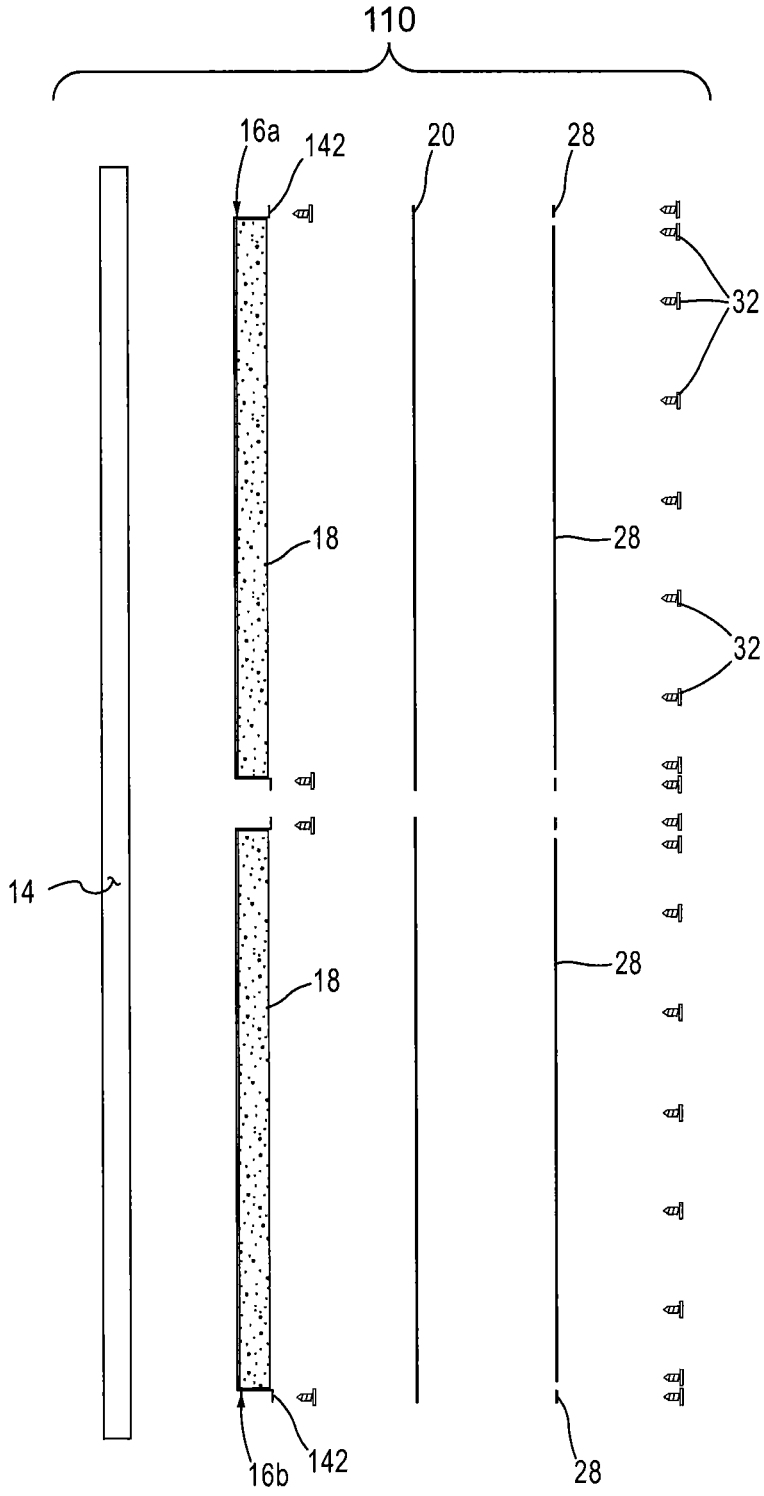
FIG. 15 is an exploded side elevation view, partially assembled, of the second exemplary embodiment of the noise abatement wall of the present invention shown in FIG. 14.
Figure 16:
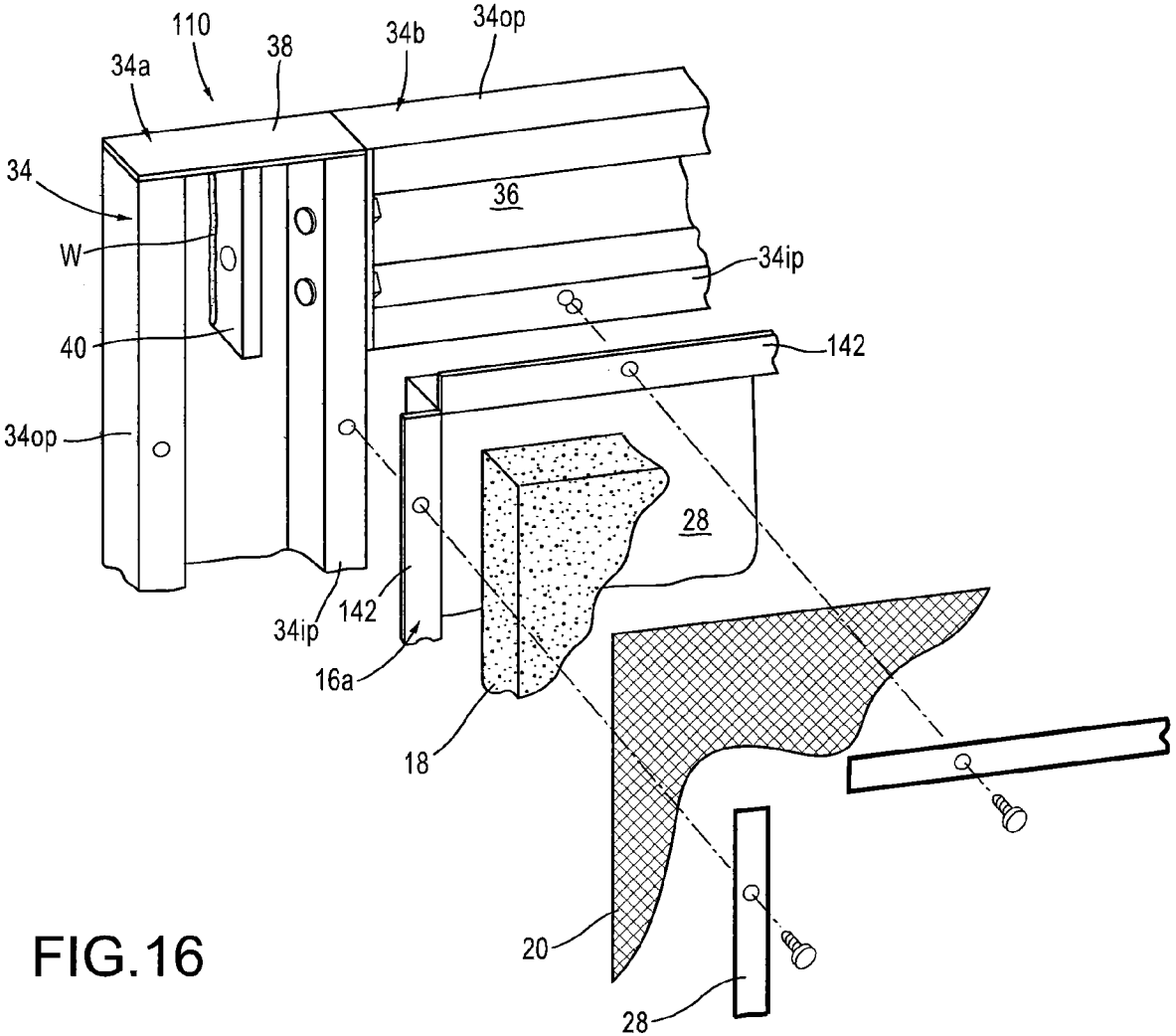
FIG. 16 is an enlarged, partial, exploded perspective view of the second exemplary embodiment of the noise abatement wall of the present invention with the frame assembled.
Figure 17:
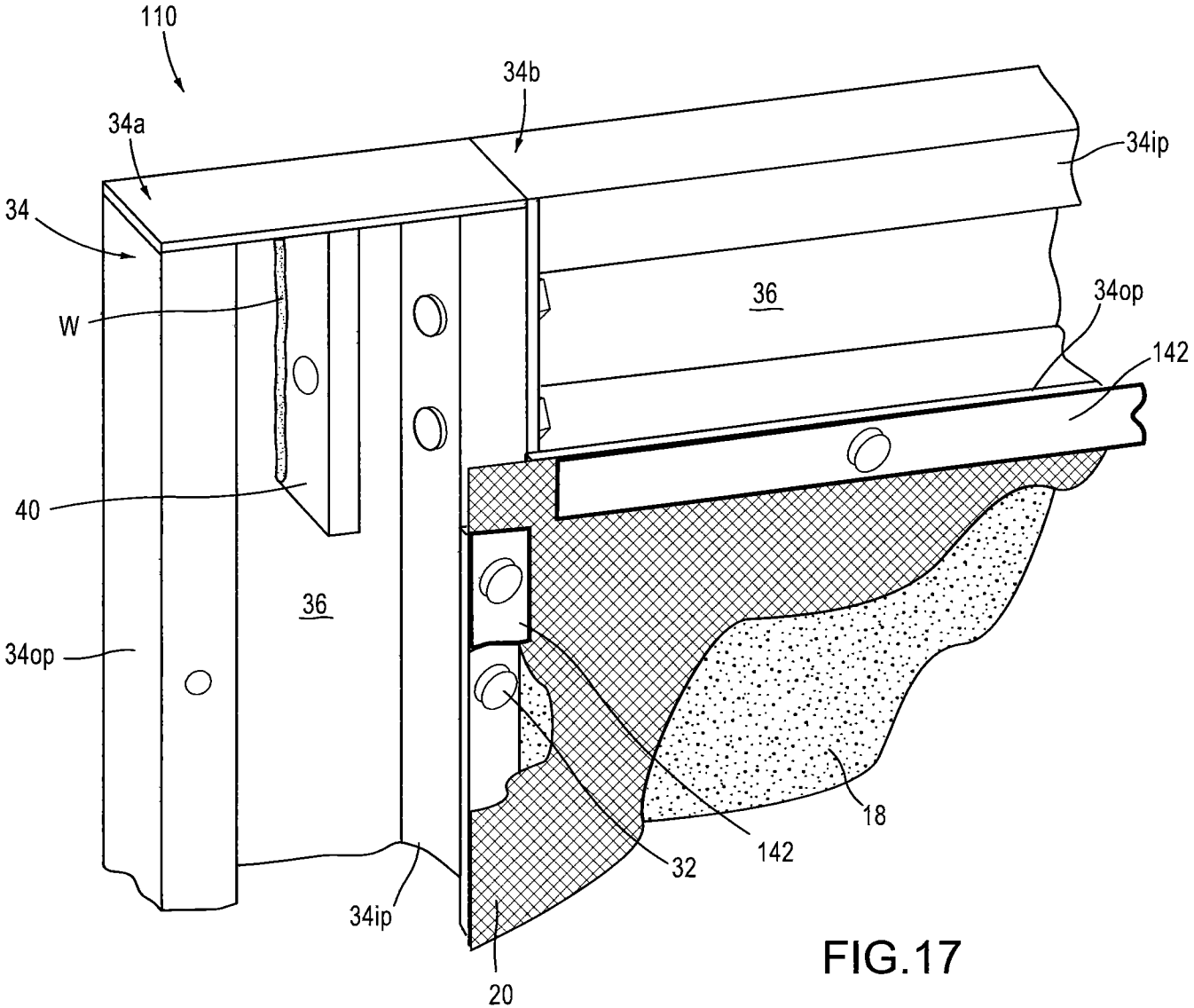
FIG. 17 is an enlarged, assembled, exploded perspective view of the second exemplary embodiment of the noise abatement wall of the present invention shown in FIG. 16.

A second exemplary embodiment of a noise abatement wall 110 of the present invention is introduced in FIGS. 10-17. The noise abatement wall 110 includes a first shell 16*a*, a second shell 16*b* and an inner cross frame piece 134 as an additional piece to the frame 12. The inner cross frame piece 134, when connected, divides the window 14 into a first window portion 14*a* and a second window portion 14*b*. Each one of the shells 16*a* and 16*b* includes a plurality of flange elements 142 as best shown in FIG. 13. Respective ones of the plurality of flange elements 142 are integrally and perpendicularly connected to respective ones of the peripheral panel portion sections 24*a*-24*d* and extend away from the shell cavity 26. With reference to FIGS. 12, 16 and 17, the first window portion 14*a* is sized to receive the first shell 16*a* in a close-fitting relationship and the second window 14*b* is sized to receive the second shell 16*b* in a close-fitting relationship. Now, each one of the first and second shells 16*a* and 16*b* is connected to the frame 12 with mechanical fasteners 32 at the flange elements 142 as best shown in FIGS. 12 and 17.

In FIGS. 10-12, the inner cross frame piece 134 is disposed between and extends parallel to the pair of outer cross frame pieces 34*b*. Also, the inner cross frame piece 134 extends between and is connected to the inner rectangular-tubing portions 34*ip* of the pair of side frame pieces 34*a*, which, as mentioned above, divides the window 14 into the first window portion 14*a* and the second window portion 14*b*.

Again with reference to FIGS. 10-12, for the second exemplary embodiment of the noise abatement wall 110 of the present invention, one of the plurality of support connectors 40 is connected in each closed channel 36 of each one of the pair of side frame pieces 34*a* adjacent the upper most one of the pair of outer cross frame pieces 34*b*. Further, one of the plurality of support connectors 40 is connected in each closed channel 36 of each one of the pair of side frame pieces 34*a* adjacent the inner cross frame piece 134.

As illustrated by way of example only in FIGS. 10 and 11 and not by way of limitation, the second exemplary embodiment of the noise abatement wall 110 of the present invention includes a plurality of support members 144. Respective ones of the plurality of support members 144 connect to respective ones of the support connectors 40 at distal support member ends 144*a* of the support members 144. Also, by way of example only in FIGS. 10 and 11, the second exemplary embodiment of the noise abatement wall 110 of the present invention includes a plurality of cross support members 146. With the support members 144 connected to the support connectors 40 adjacent the upper most one of the pair of outer cross pieces 34*b*, proximal support member ends 144*b* disposed opposite the distal support member ends 144*a* are interconnected by one of the plurality of cross support members 146. And, the support members 144 connected to the support connectors 40 adjacent the inner cross frame piece 134 are interconnected by one of the plurality of cross support members 146 at the proximal support member ends 146*b*.

One of ordinary skill in the art would appreciate that the support members 144 discussed above with or without the cross support members 146 can be connected to the support connectors 40 of the first exemplary embodiment of the noise abatement wall 10 of the present invention such that respective ones of the plurality of support members 144 are releasably or fixedly connected to respective ones of the support connectors 40 by conventional fasteners or weldment.

Figure 18:
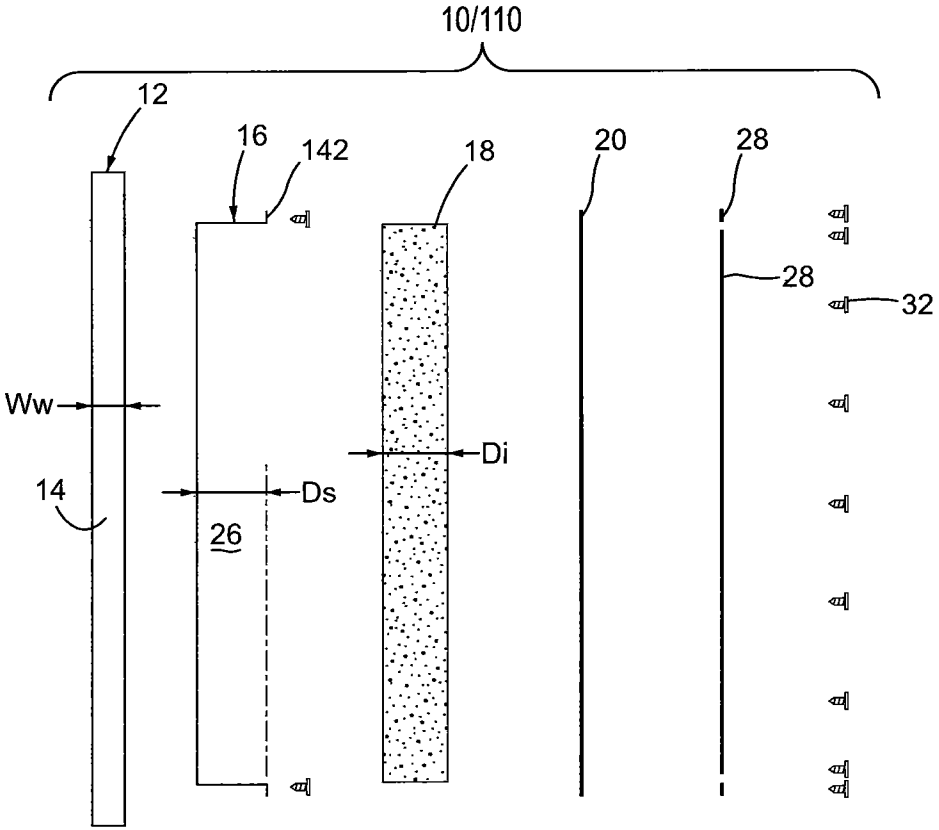
FIG. 18 is an exploded side elevation view a modified noise abatement wall of the present invention.

Note in FIG. 4 for the first exemplary embodiment of the noise abatement wall 10 of the present invention and for the second exemplary embodiment of the noise abatement wall 110 of the present invention, a width Ww of the window 14 formed by the frame 12, a depth of the shell cavity Ds and a depth of the sound-insulating material Di are either equal or substantially equal to each other. Once assembled, the resultant noise abatement wall 10 appears in side elevation view in FIG. 3, i.e. the components are substantially flush with one another. By contrast, in FIGS. 18 and 19, note that the width Ww of the window 14 is less than the depth Ds of the shell cavity 26 and the depth Di of the sound-insulating material 18 while the depth Ds of the shell cavity Ds and the depth of the sound-insulating material 18 is either equal to or approximately equal to each other. A skilled artisan would appreciate that a noise abatement wall can be improved in its noise abatement characteristics by simply increasing the depth Ds of the shell cavity 26 and the depth Di of the sound insulating material 18 without modifying any of the other components of the noise abatement wall.

Figure 19:
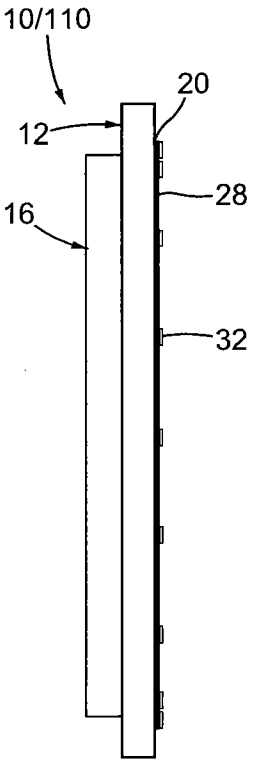
FIG. 19 is a side elevation view of the modified noise abatement wall of the present invention shown in FIG. 18.
Figure 20:
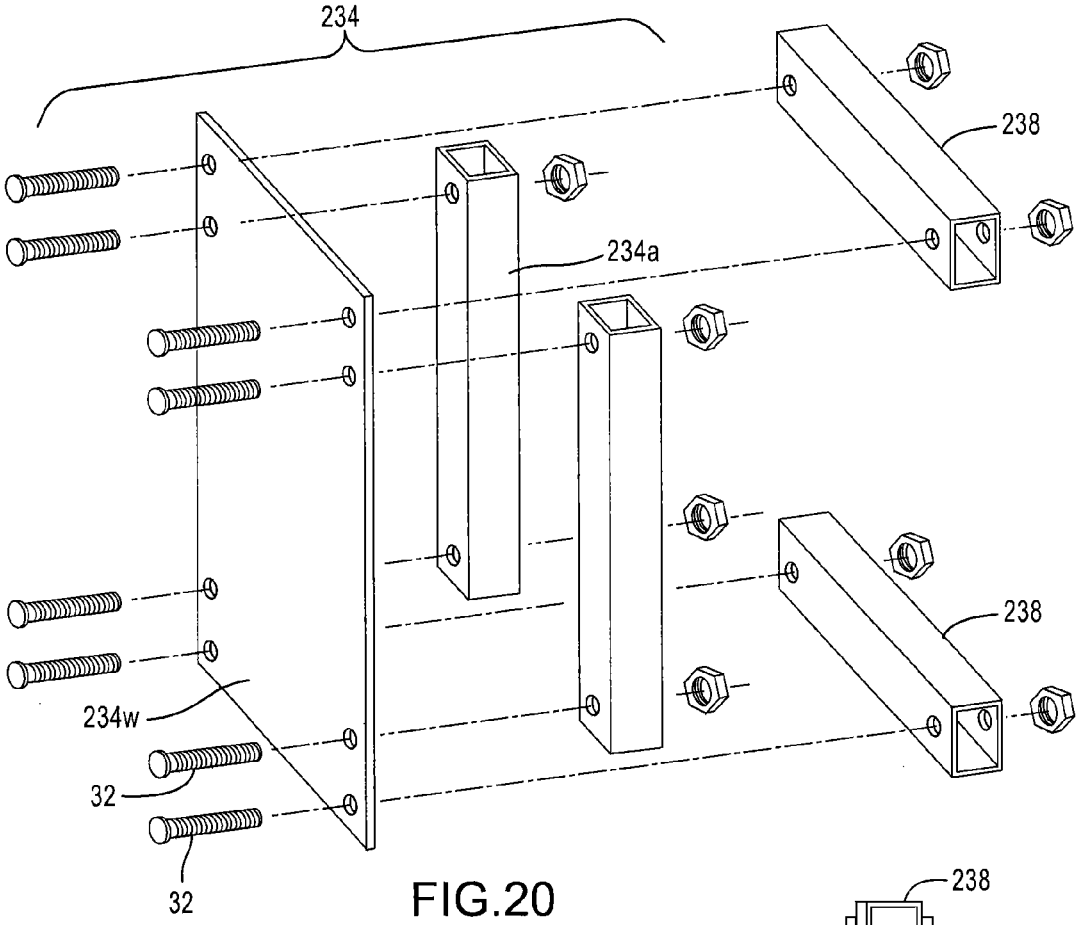
FIG. 20 is an exploded perspective view of an alternative web portion of a frame piece.
Figure 21:
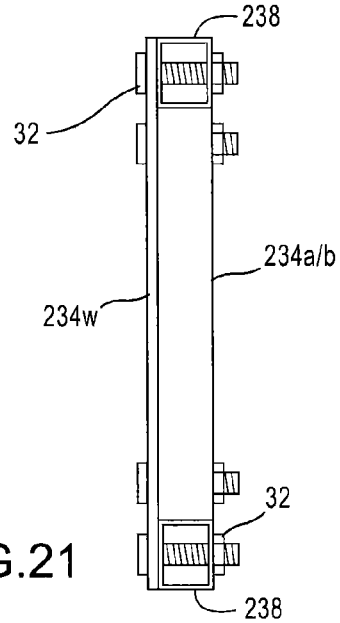
FIG. 21 is a side elevation view of the alternative web portion of the frame piece shown in FIG. 20.
Figure 23:
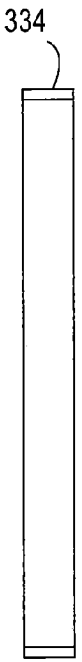
FIG. 23 is a side elevation view of the plate after being folded 90° along the dashed fold lines.
Figure 22:
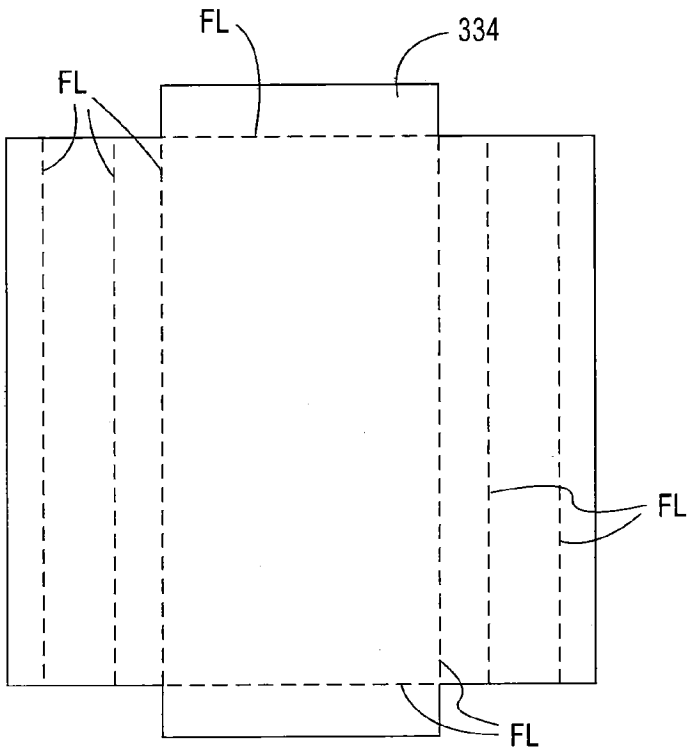
FIG. 22 is a front elevation view of a plate with dashed fold lines before folding the plate into a frame piece.

The above-described embodiments of the noise abatement wall illustrate that the frame pieces 34 can, in essence, be fabricated by welding a web plate to and between a disposed apart pair of square tubes. However, frame pieces for the embodiments of the invention are not limited to this. As shown in FIGS. 19 and 20, a frame piece 234 can be fabricated by fastening a web plate 234*ws* to a disposed-apart pair of square tubes 234*a* extending parallel to each other and a pair of end parts 238 in a form of hollow tubes. One of ordinary skill in the art would appreciated the pair of square tubes 234*a* can be either hollow or solid and the pair of end parts 238 can also be solid and not hollow.

Figure 25:
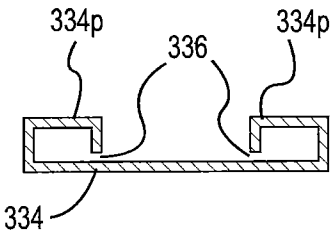
FIG. 25 is a diagrammatic cross-section view of the plate after being folded 90° along the dashed fold lines taken along line 25-25 in FIG. 24.
Figure 24:
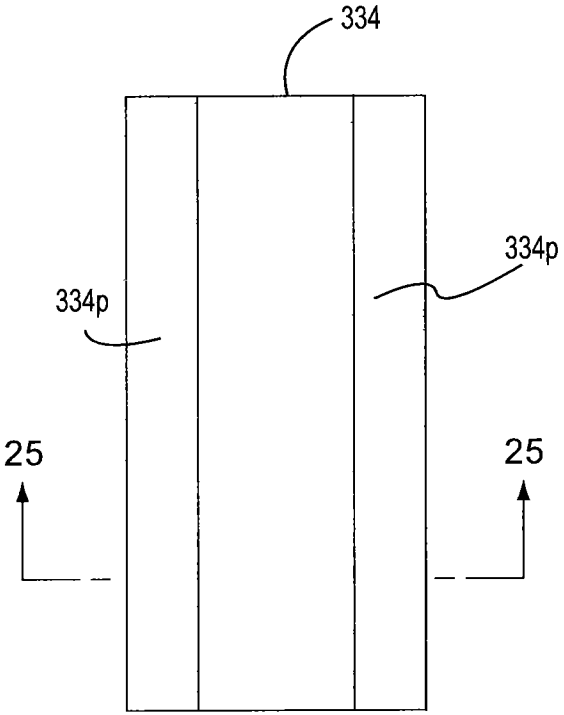
FIG. 24 is a front elevation view of the plate after being folded 90° along the dashed fold lines.
Figure 26:
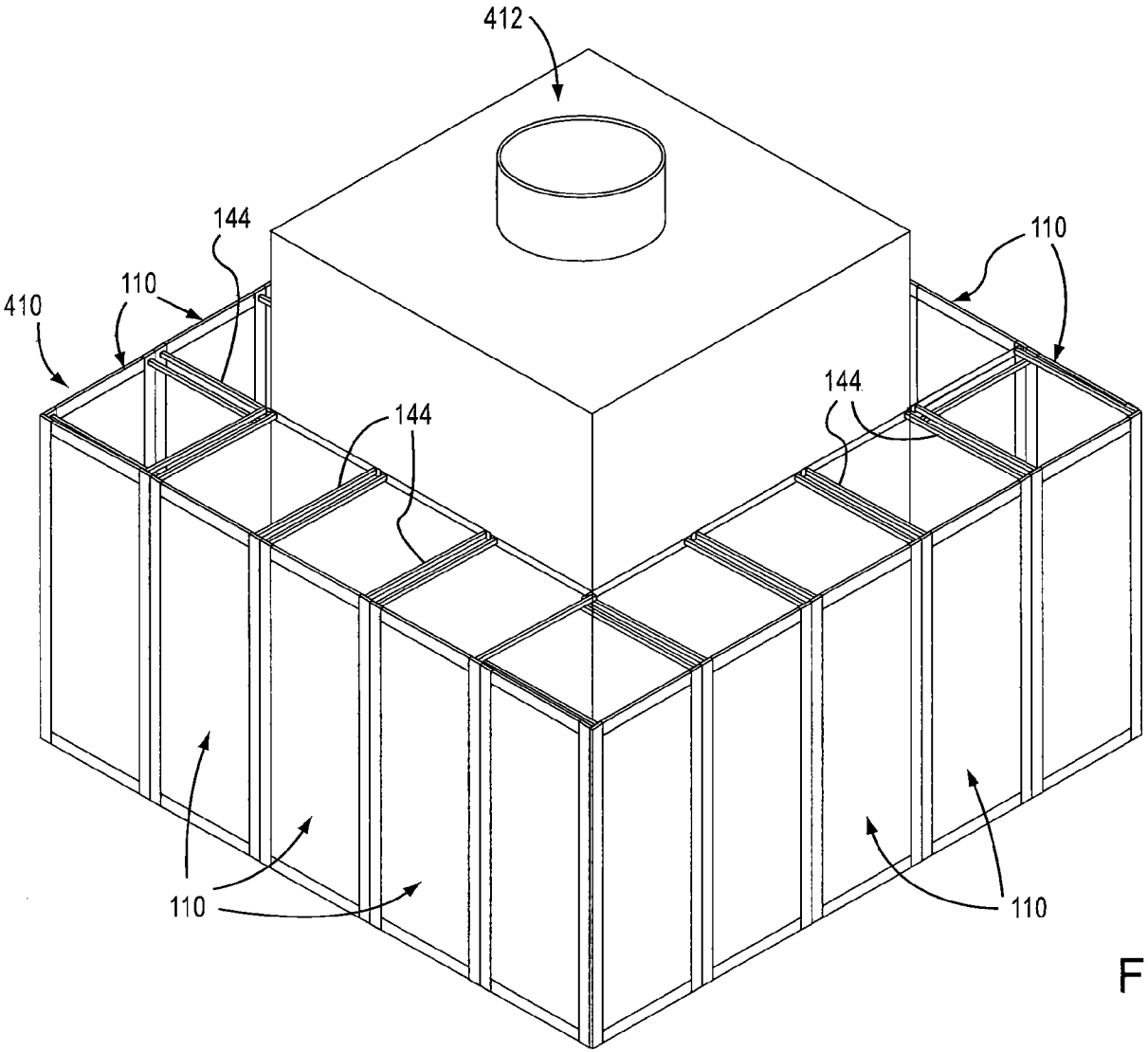
FIG. 26 is a perspective view of a third exemplary embodiment of a noise abatement wall system of the present invention surrounding an evaporative cooling device that generates noise.

Another alternative to fabricate the frame piece 34 is by folding a flat sheet 334 of malleable metal 90° along fold lines fl. Note in FIG. 24 that the side walls of the rectangular tubing portions 334*p* in cross-section are not square but rectangular. Further, because of folding, the rectangular tubing portions 334*p* has a split 336. Thus, it is not necessary to use square tubing and it is acceptable to use split rectangular tubing as best shown in FIG. 25. Furthermore, rather than using hollow tubing stock, a skilled artisan would appreciate that solid square or solid rectangular stock can also be employed in lieu thereof.

A third exemplary embodiment of a noise abatement wall system 410 of the present invention is hereinafter described with reference to FIG. 25. As best shown in FIG. 25, the noise abatement wall system 410 is adapted to abate noise generated from stationary noise-generating equipment such as an evaporative cooling device 412, for example, and includes a plurality of noise abatement walls 110 of the present invention. The plurality of the noise abatement walls 110 are connected together by conventional fasteners 32 as best shown in FIGS. 8 and 9. The plurality of noise abatement walls 110 are connected together in a juxtaposed configuration so as to surround the evaporative cooling device 412. The noise abatement wall system 410 is disposed apart from the evaporative cooling device 412 but is connected to it by a plurality of support members 144 as discussed above. The bottom of the noise abatement wall system 410 could rest on the same support surface as the evaporative cooling device 412 or it can be suspended above the support surface supporting the evaporative cooling device 412.

Figure 27:
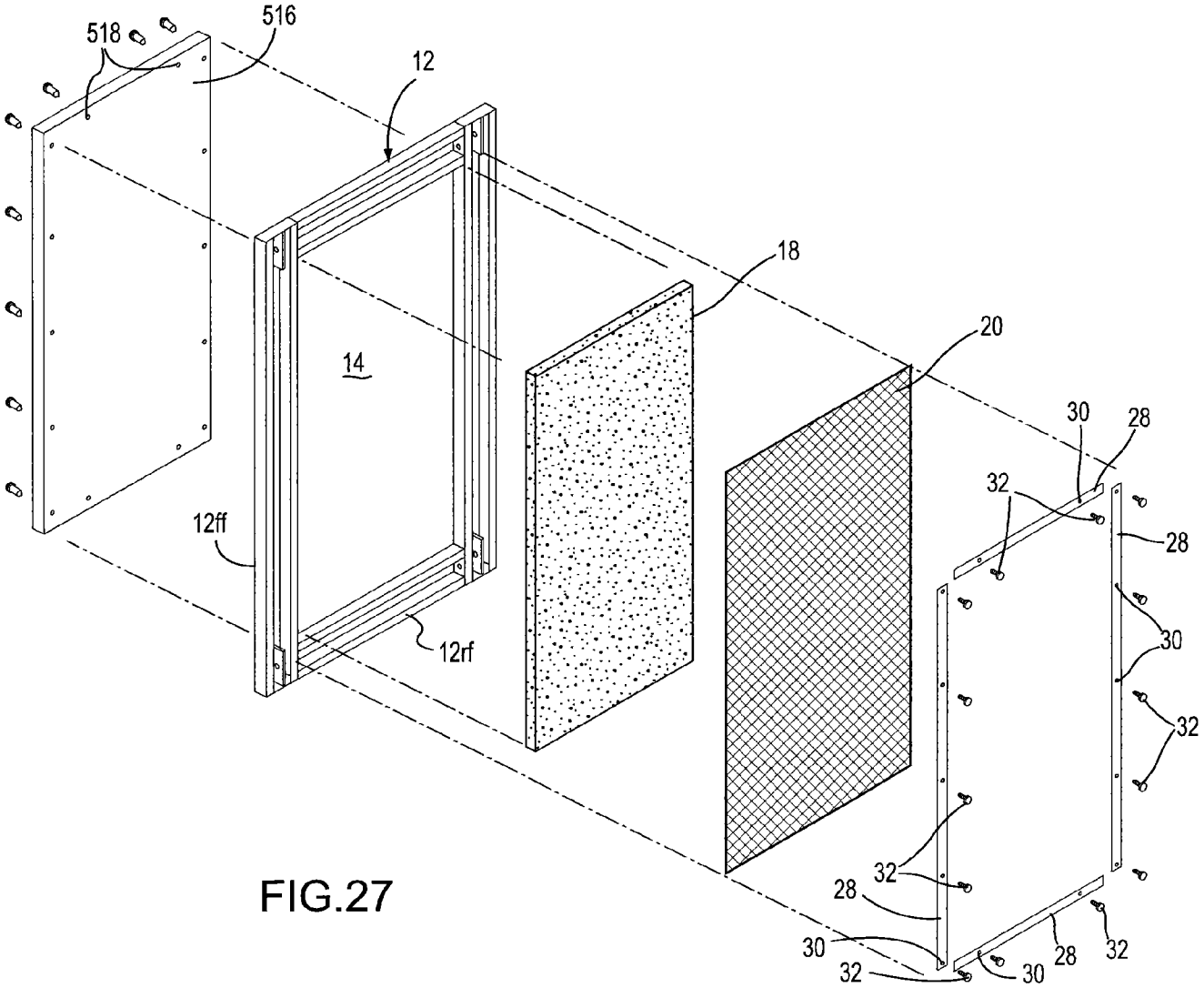
FIG. 27 is an exploded perspective view of a fourth exemplary embodiment of a noise abatement wall of the present invention.
Figure 28:
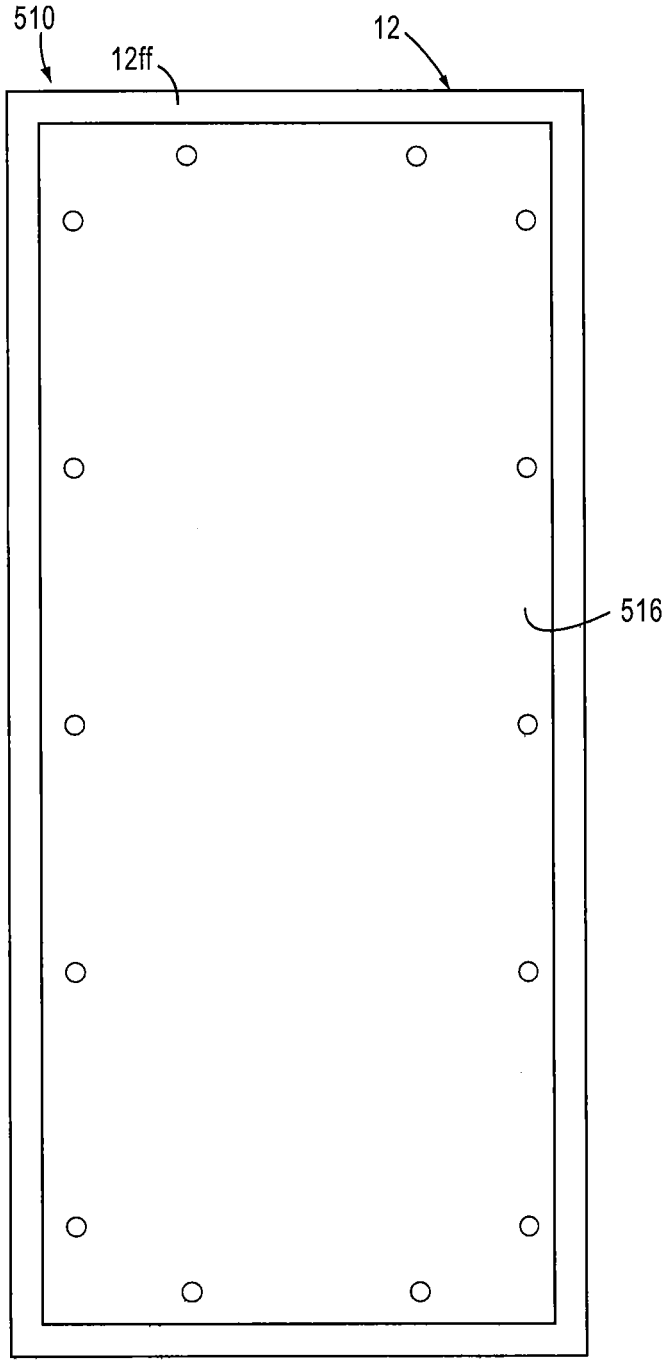
FIG. 28 is a front elevation view of the fourth exemplary embodiment of the noise abatement wall of the present invention.
Figure 29:
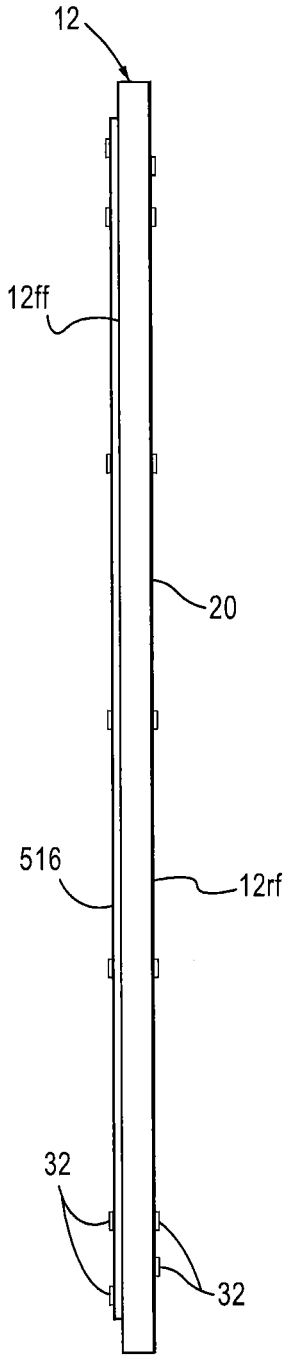
FIG. 29 is a side elevation view of the fourth exemplary embodiment of the noise abatement wall of the present invention.

A fourth exemplary embodiment of a noise abatement wall 510 of the present invention is hereinafter described with reference to FIGS. 27-29. The noise abatement wall 510 is similar to the first and second exemplary embodiments of the noise abatement walls 10 and 110 respectively described above. Note that the noise abatement wall 510 excludes the shell 16 but includes a cover panel 516 formed with holes 518. Now, instead of the sound-insulating material 18 being disposed in the shell cavity 26 as described for to the first and second exemplary embodiments of the noise abatement walls 10 and 110 respectively described above, the sound-insulating material 18 is received by and at least substantially occupies the window 14. Further, the cover panel is secured to the front of the frame 12 with conventional fasteners 32 as best illustrated in FIGS. 28 and 29.

More particularly, the noise abatement wall 510 includes the frame 12 that defines the window 14, the cover panel 516, the at least one sheet of sound-insulating material 18 and the sheet of screen material 20. The frame 12 has a front frame face 12*ff* and a rear frame face 12*rf*. The cover panel 516 is sized to cover the window 14 and is connected to the front frame face 12*ff* of the frame 12. The at least one sheet of sound-insulating material 18 is disposed in the window 14 and contacts the cover panel 516. The sheet of screen material 20 covers the at least one sheet of sound-insulating material 18 and is connected to the rear frame face 12*rf* of the frame 12.

Figure 30:
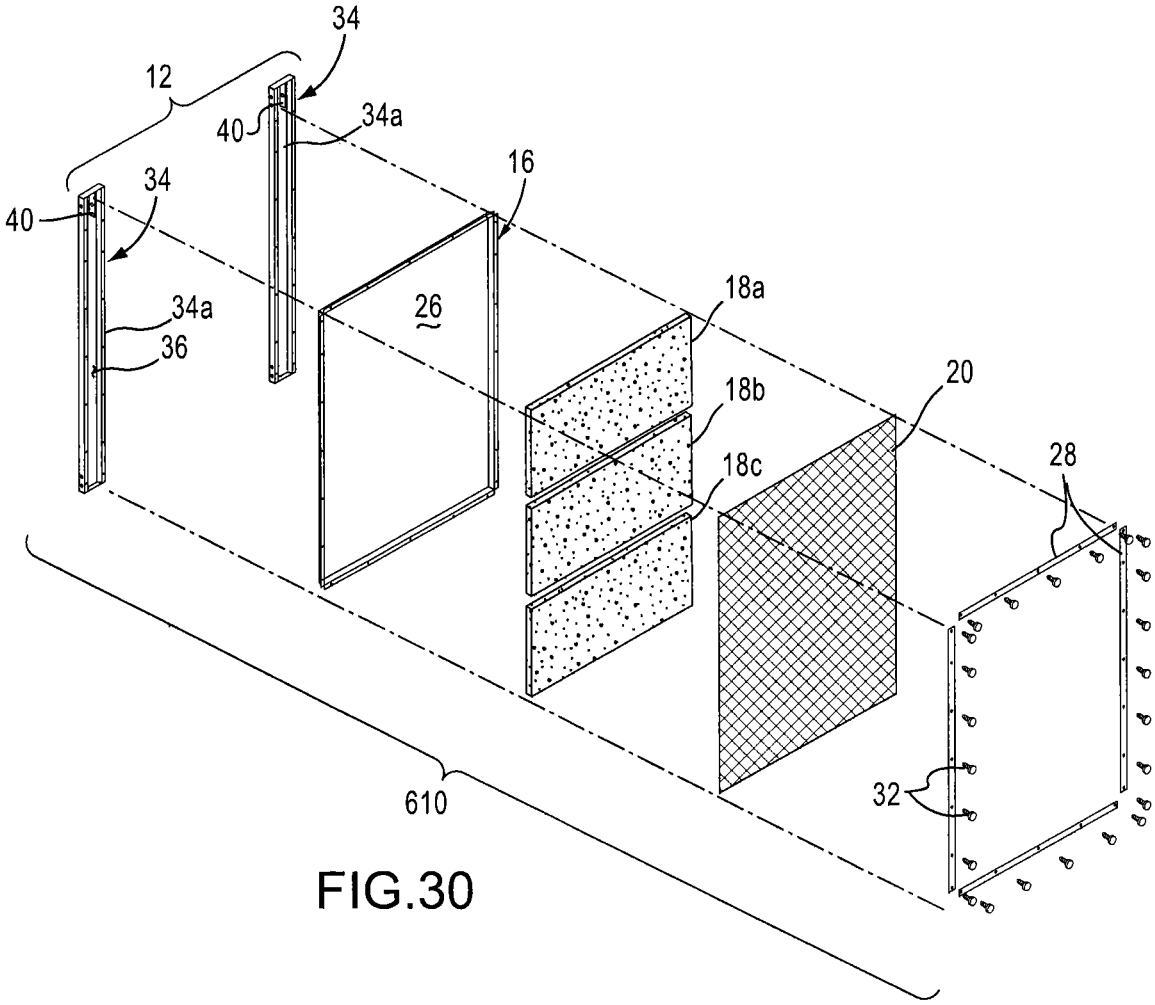
FIG. 30 is an exploded perspective view of a fifth exemplary embodiment of a noise abatement wall of the present invention.

A fifth exemplary embodiment of a noise abatement wall 610 of the present invention is hereinafter described with reference to FIG. 30. Note that the frame 12 includes a pair of side frame pieces 34*a*. The pair of side frame pieces 34*a* are disposed apart from one another and extend vertically parallel to one another. Also, instead of one sheet of sound-insulating material 18 as described above, there are a plurality of sheets of sound-insulating material 18*a*, 18*b* and 18*c*, shown by way of example only and not by way of limitation, that are received in the shell cavity 26. Additionally, a single support connector 40 is disposed in the closed channel 36 of each one of the pair of side frame pieces 34*a* at the vertical top thereof.

Figure 31:
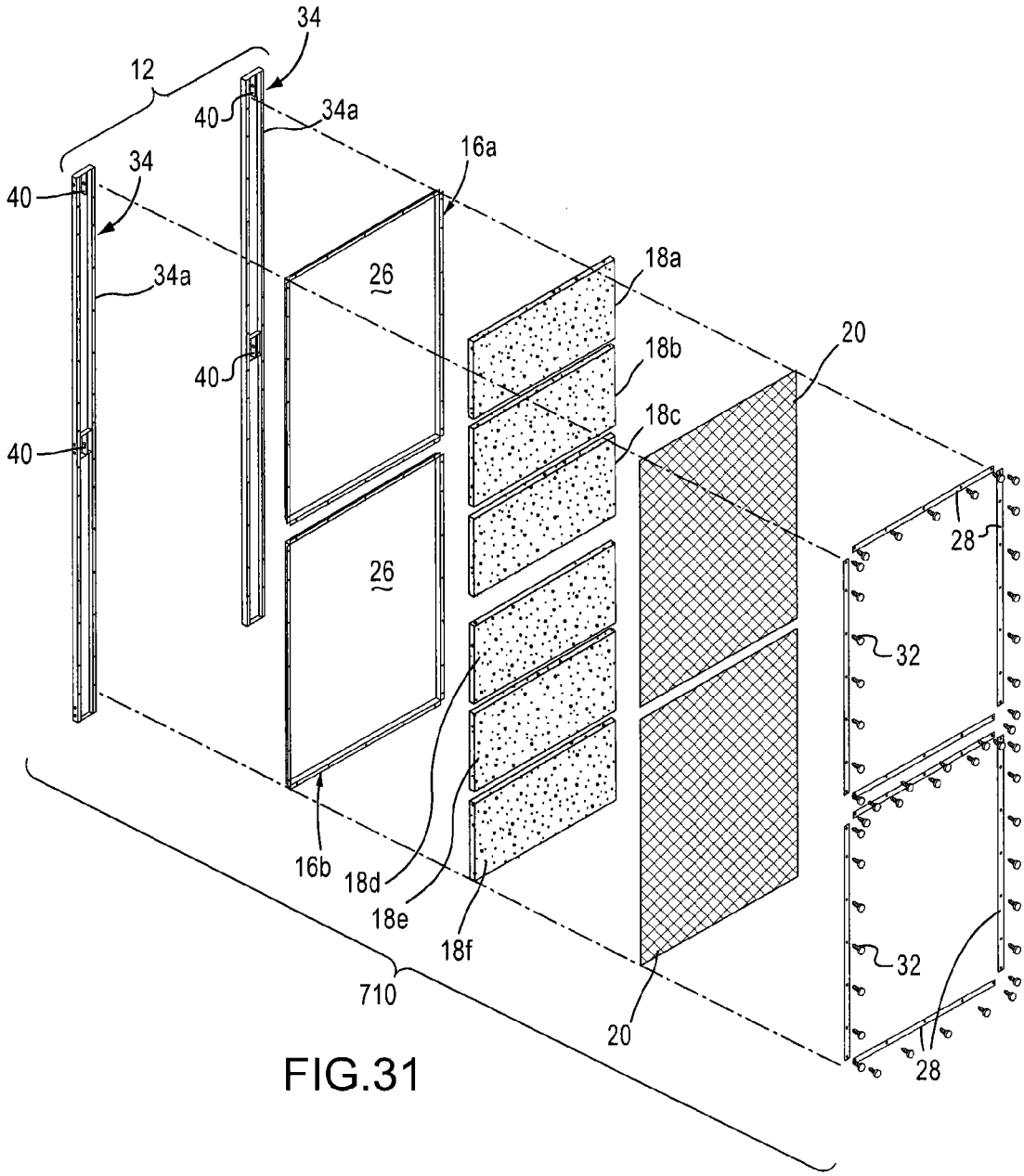
FIG. 31 is an exploded perspective view of a sixth exemplary embodiment of a noise abatement wall of the present invention.

A sixth exemplary embodiment of a noise abatement wall 710 of the present invention is hereinafter described with reference to FIG. 31 and is similar to the noise abatement wall 610 of the fifth exemplary embodiment of the present invention. The noise abatement wall 710 includes a pair of shells 16*a* with one vertically positioned above the other for connection to the frame 12. There are a plurality of sheets of sound-insulating material 18*a*, 18*b* and 18*c* that are received in the shell cavity 26 of the shell 16*a* and there are a plurality of sheets of sound-insulating material 18*d*, 18*e* and 18*f* that are received in the shell cavity 26 of the shell 16*b*. Also, a pair of support connectors 40 are disposed in the closed channel 36 of each one of the pair of side frame pieces 34*a*. For each one of the pair of side frame pieces 34, one support connector 40 is disposed at the vertical top thereof and the other support connector 40 is disposed generally centrally between the top and bottom of the side frame piece 34.

Figure 32:
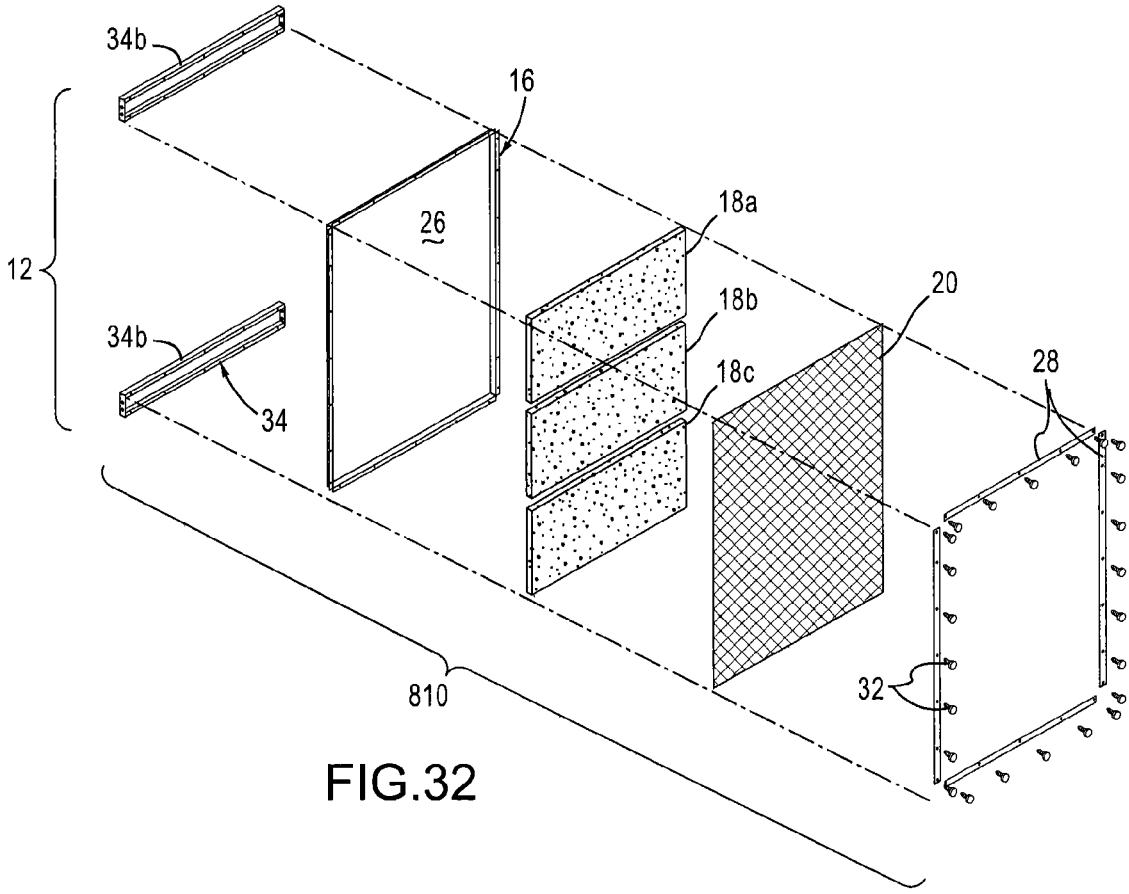
FIG. 32 is an exploded perspective view of a seventh exemplary embodiment of a noise abatement wall of the present invention.

A seventh exemplary embodiment of a noise abatement wall 810 of the present invention is hereinafter described with reference to FIG. 32. Note that the frame 12 includes two cross frame pieces 34*b*. The two cross frame pieces 34*b* are disposed apart from one another and extend horizontally parallel to one another.

Figure 33:
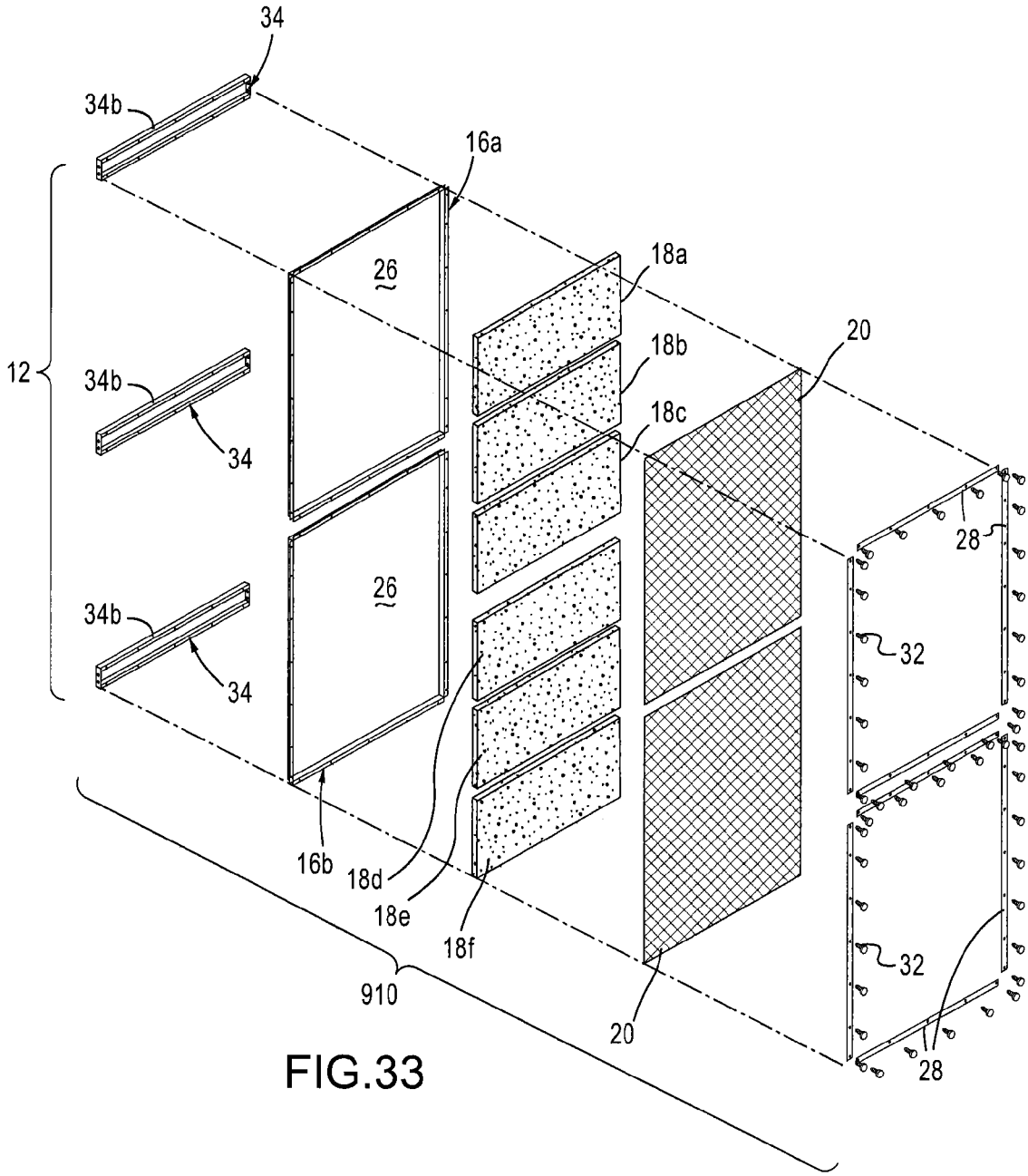
FIG. 33 is an exploded perspective view of an eighth exemplary embodiment of a noise abatement wall of the present invention.

A eighth exemplary embodiment of a noise abatement wall 910 of the present invention is hereinafter described with reference to FIG. 33. Note that the frame 12 includes three cross frame pieces 34*b*. However, one of ordinary skill in the art would appreciate that the frame 12 might include more than three cross frame pieces 34*b*. The two cross frame pieces 34*b* are disposed apart from one another and extend horizontally parallel to one another.

In consideration of the description of the exemplary embodiments of the invention, the noise abatement walls of the present invention can be constructed at the factory and delivered to the construction or set-up site for assembly around noise-generating mechanical equipment thereby minimizing efforts of field personnel to construct the noise abatement wall system. Furthermore, although not by way of limitation, the noise abatement walls could be secured to the noise-generating mechanical equipment itself after its construction or set-up in the field thereby assembling the noise abatement wall system of the present invention in the field. One of ordinary skill in the art would appreciate that these benefits are mutually exclusive of one another. In other words, the noise abatement wall system does not require that the noise abatement walls be secured to the noise-generating mechanical equipment and, as such, is not a departure from the spirit or inventive concepts of the invention.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. A noise abatement wall, comprising:

a frame forming a window and defining a window opening area with a window depth extending in a window depth direction; and at least one shell having a flat base panel portion and a peripheral panel portion integrally formed with and extending perpendicularly from the base panel portion in the window depth direction to surround the base panel portion to form a one-half clamshell configuration defining an open shell cavity having an open shell cavity depth, the base panel portion sized to be substantially equal to yet less than the window opening area so that the at least one shell is received by the window with the peripheral panel portion juxtaposed to and facing the frame in a close-fitting relationship and the open shell cavity depth being equal to or greater than the window depth, the at least one shell being connected to the frame.

2. A noise abatement wall according to claim 1, further comprising at least one sheet of sound-insulating material sized to be received into and fully occupy the open shell cavity.

3. A noise abatement wall according to claim 2, further comprising a sheet of screen material covering the at least one sheet of sound-insulating material and connected to the frame.

4. A noise abatement wall according to claim 1, wherein the base panel portion is flat and rectangularly shaped and the peripheral panel portion includes four flat and rectangularly-shaped peripheral panel portion sections with each one of the four peripheral panel portion sections having a first peripheral edge and an opposite second peripheral edge extending parallel to the first section edge and defining a uniform peripheral panel portion width therebetween, and wherein consecutive ones of the peripheral panel portion sections are perpendicularly and integrally connected together to form a rectangular configuration, the peripheral panel portion being integrally connected to the base panel portion along respective ones of the first peripheral edges to form a box-shaped open shell cavity and respective ones of the second peripheral edges defining a shell cavity opening into the open shell cavity.

5. A noise abatement wall according to claim 4, wherein the at least one shell includes a plurality of flange elements, respective ones of the plurality of flange elements are integrally and perpendicularly connected to respective ones of the peripheral panel portion sections at and along the respective ones of the second peripheral edges and extend away from the open shell cavity.

6. A noise abatement wall according to claim 5, further comprising a plurality of mechanical fasteners and wherein the at least one shell is connected to the frame with the mechanical fasteners at either the peripheral panel portion sections or the flange elements.

7. A noise abatement wall according to claim 5, wherein the at least one sheet of sound-insulating material occupies at least substantially the entirety of the open shell cavity.

8. A noise abatement wall according to claim 1, further comprising at least one sheet of sound-insulating material disposed and retained in the open shell cavity and a sheet of screen material covering the at least one sheet of sound-insulating material and connected to the frame.

9. A noise abatement wall according to claim 8, further comprising a plurality of strip members having a plurality of holes formed therethrough, respective ones of the strip members being connected to the frame with the sheet of screen material disposed between the respective ones of the strip members and the frame.

10. A noise abatement wall according to claim 9, wherein the sheet of screen material and the at least one sheet of sound-insulating material are in facial contact with each other, and, when the respective ones of the strip members are connected to the frame with the sheet of screen material disposed between the respective ones of the strip members and the frame, the sheet of screen material retains the at least one sheet of sound-insulating material in the open shell cavity.

11. A noise abatement wall according to claim 1, further comprising at least one sheet of sound-insulating material disposed and retained in the open shell cavity and a sheet of screen material covering the at least one sheet of sound-insulating material and connected to the frame.

12. A noise abatement wall according to claim 11, wherein the frame includes a plurality of frame pieces having a pair of side frame pieces disposed apart from and extending parallel to one another and a pair of outer cross frame pieces disposed apart from and extending parallel to one another, respective ones of the pair of side frame pieces and the pair of outer cross frame pieces being perpendicularly connected together to form the window with a rectangular shape, each one of the frame pieces including an outer rectangular-tubing portion and an inner rectangular-tubing portion disposed apart from each other and extending parallel to one another and a web portion extending between and interconnecting the outer rectangular-tubing portion and the inner rectangular-tubing portion to form a channel extending along and between the outer and inner rectangular-tubing portions.

13. A noise abatement wall according to claim 12, wherein each one of the frame pieces has a pair of end parts facially opposed to and disposed apart from each other, respective ones of the pair of end parts extending across and between respective ends of the outer and inner rectangular-tubing portions and connected to the web portion to close the channel between and among the outer rectangular-tubing portion, the inner rectangular-tubing portion, the web portion and the pair of end parts.

14. A noise abatement wall according to claim 13, wherein each one of the pair of end parts is one of a plate and a tube.

15. A noise abatement wall according to claim 13, further comprising a plurality of support connectors disposed in the closed channel and connected at least to the web portion and between the outer and inner rectangular-tubing portions, at least one of the plurality of support connectors being connected in each one of the pair of side frame pieces.

16. A noise abatement wall according to claim 15, further comprising a plurality of support members, respective ones of the plurality of support members being connect to respective ones of the support connectors.

17. A noise abatement wall according to claim 13, wherein the at least one shell is connected to the inner rectangular-tubing portions.

18. A noise abatement wall according to claim 13, further comprising a plurality of strip members having holes formed therethrough, respective ones of the strip members being connected to the frame with the sheet of screen material disposed between the respective ones of the strip members and the frame and, wherein, when the respective ones of the strip members are connected to the frame with the sheet of screen material disposed between the respective ones of the strip members and the frame, the respective ones of the strip members are connected to the inner square-tube portions.

19. A noise abatement wall according to claim 13, further comprising a plurality of mechanical fasteners and wherein respective ones of the pair of side frame pieces and respective ones of the pair of the outer cross frame pieces are connected together in a manner that respective ones of the end parts of the pair of outer cross frame pieces abut respective ones of the inner rectangular-tubing portions and are releasably connected together with the mechanical fasteners.

20. A noise abatement wall according to claim 19, further comprising an inner cross frame piece and wherein the at least one shell includes two shells, the inner cross frame piece disposed between and extending parallel to the pair of outer cross frame pieces and extending to and between and connected to the inner rectangular-tubing portions of the pair of side frame pieces so as to divide the window into a first window portion and a second window portion, respective ones of the two shells sized and configured to be received by respective ones of the first window portion and the second window portion.

21. A noise abatement wall according to claim 20, further comprising a plurality of support connectors disposed in the closed channel and connected at least to the web portion and between the outer and inner rectangular-tubing portions, one of the plurality of support connectors being connected in each closed channel of each one of the pair of side frame pieces adjacent an upper most one of the pair of outer cross frame pieces and one of the plurality of support connectors being connected in each closed channel of each one of the pair of side frame pieces adjacent the inner cross frame piece.

22. A noise abatement wall according to claim 21, further comprising a plurality of support members, respective ones of the plurality of support members being connect to respective ones of the support connectors at distal support member ends of the support members.

23. A noise abatement wall according to claim 22, further comprising a plurality of cross support members and wherein the support members connected to the support connectors adjacent the upper most one of the pair of outer cross pieces are interconnected by one of the plurality of cross support members at proximal support member ends disposed opposite the distal support member ends and the support members connected to the support connectors adjacent the inner cross frame piece are interconnected by one of the plurality of cross support members at the proximal support member ends of the support members.

24. A noise abatement wall according to claim 11, wherein the frame includes a pair of side frame pieces disposed apart from and extending vertically parallel to one another.

25. A noise abatement wall according to claim 11, wherein the frame includes at least two outer cross frame pieces disposed apart from and extending horizontally parallel to one another.

26. A noise abatement wall system adapted to abate noise generated from stationary noise-generating equipment, comprising:

a plurality of noise abatement walls according to claim 1 connected together in a juxtaposed configuration to surround the stationary noise-generating equipment.

27. A noise abatement wall, comprising:

a frame having a front frame face and a rear frame face and forming a window, the window defining a window opening area with a window depth extending in a window depth direction to and between the front frame face and the rear frame face;

a cover panel sized to cover the window opening area and connected to the front frame face of the frame;

at least one sheet of sound-insulating material disposed in the window and having a sound-insulating material depth at least substantially equal to the window depth, the at least one sheet of sound-insulating material being in contact with the cover panel and the frame, occupying the entirety of the window area and extending from the cover panel to the rear frame face; and a sheet of screen material covering and facially contacting the at least one sheet of sound-insulating material and connected to and in contact with the rear frame face of the frame.

* * * * *